US010874585B1

(12) United States Patent
Vo

(10) Patent No.: US 10,874,585 B1
(45) Date of Patent: Dec. 29, 2020

(54) SYSTEM AND METHOD FOR MICROBUBBLE GENERATION

(71) Applicant: MICRO CLEAN CORPORATION, Rancho Cucamonga, CA (US)

(72) Inventor: Henry Vo, Rancho Cucamonga, CA (US)

(73) Assignee: Micro Clean Corporation, Rancho Cucamonga, CA (US)

( * ) Notice: Subject to any disclaimer, the term of this patent is extended or adjusted under 35 U.S.C. 154(b) by 0 days.

(21) Appl. No.: 16/900,081

(22) Filed: Jun. 12, 2020

Related U.S. Application Data

(60) Provisional application No. 62/862,413, filed on Jun. 17, 2019.

(51) Int. Cl.
*A61H 33/02* (2006.01)
*A61H 33/00* (2006.01)
*B01F 3/04* (2006.01)

(52) U.S. Cl.
CPC ..... *A61H 33/02* (2013.01); *A61H 33/601* (2013.01); *A61H 33/6068* (2013.01); *B01F 3/0446* (2013.01); *B01F 2003/04858* (2013.01)

(58) Field of Classification Search
CPC .. A61H 33/02; A61H 33/601; A61H 33/6068; B01F 3/6068; B01F 2003/04858
USPC ..... 4/622
See application file for complete search history.

(56) References Cited

U.S. PATENT DOCUMENTS

2008/0189847 A1* 8/2008 Yamasaki ..... A61H 33/6073 4/541.4
2010/0176520 A1 7/2010 Cunningham et al.
2012/0085442 A1* 4/2012 Chen ..... A61H 33/02 137/565.36
2018/0296991 A1* 10/2018 Park ..... B01F 3/04815
2019/0104891 A1* 4/2019 Tran ..... A47K 3/001
2019/0143351 A1* 5/2019 Rivera ..... A61H 33/6068 239/428.5
2020/0069515 A1 3/2020 Onari et al.

FOREIGN PATENT DOCUMENTS

CA 2890414 C 9/2016
CN 106038228 A 10/2016
WO 2016023394 A1 2/2016

* cited by examiner

*Primary Examiner* — Huyen D Le
(74) *Attorney, Agent, or Firm* — Houda El-Jarrah; Thomas E. La Grandeur; Bold IP, PLLC

(57) ABSTRACT

One or more systems are disclosed for producing microbubbles in a standard tub as well as a pedicure tub for performing pedicures on a user. The one or more systems include a microbubble generating device. The microbubble generating device includes its own housing and is portable or can be attachable to one or more structures such as a pedicure chair. The microbubble generating device includes a pump, an air mixing chamber, a solenoid valve, and electrical timer. After passing through the pump and the air mixing chamber of the microbubble generating device, the outgoing water is infused with microbubbles and redirected from an outlet of the microbubble generating device to the tub or pedicure tub. The system further includes an aerator assembly and one or more filters. Microbubbles are included in the water to provide deep cleaning and other health benefits to the user.

24 Claims, 17 Drawing Sheets

SYSTEM AND METHOD FOR MICROBUBBLE GENERATION

CROSS-REFERENCE TO RELATED APPLICATIONS

This application is a non-provisional application which claims priority to U.S. Provisional Patent Application No. 62/862,413 filed on Jun. 17, 2019, which is incorporated by reference in its entirety.

FIELD OF THE DISCLOSURE

The present invention relates to a system and method for microbubble generation. In particular, the system and methods herein relate to embodiments that allow for microbubble cleaning using a pedicure style salon chair and tub. Other systems and methods described herein relate to microbubble generating device that can be independently used with any type of tub or container for generally washing pets, objects, or any item that needs cleansing and that may benefit from the incorporation of microbubbles in the cleaning process.

BACKGROUND

The use of microbubbles while washing and bathing people, pets, or other entities is becoming more popular. Microbubbles are bubbles of water and gas (e.g. air) that are very small in size. To qualify as a microbubble, the bubble is usually less than one millimeter and greater than one micrometer. In general, for effective deep cleaning, the microbubbles are preferably very small and may range, in one or more exemplary, non-limiting embodiments, anywhere from 1-200 micrometers in size. Such small sizes may allow the microbubbles to penetrate hair follicles and skin pores to effectively remove dirt while not passing through the epidermis layer of the skin.

There are many benefits for the use of microbubbles when cleansing or bathing humans or animals. For example, microbubbles in the water expose the bather or user to oxygen-rich water. Additionally, the microbubbles provide a deeper cleaning than the use of regular water, because the microbubbles are better at attracting dirt, impurities, and toxins from the skin. Further, the use of microbubbles provides additional health benefits to the user because microbubbles help improve the overall circulation of the blood as well as an overall sense of relaxation and well-being. Microbubbles have many additional benefits. Nevertheless, it remains a challenge to produce such microbubbles and the equipment typically used for such a purpose is complex.

Pedicures are often used to relax and to maintain the hygiene and good appearance of one's legs and feet. It would be desirable to easily incorporate microbubbles in one's pedicure treatments. The problem with existing foot baths that may include microbubbles in pedicure treatments for customers is that the foot baths have to be purchased having the requisite microbubble generating technology. Owners of salons and other pedicure tubs or chairs are not able to retrofit their existing equipment to provide microbubble infused water during the pedicure. Further, any existing foot baths that incorporate the microbubble technology require complicated plumbing to pipe in the microbubble enhanced water. These existing systems are not portable and not easily connectable to most pedicure tubs and chairs that exist in an abundance of nail salons, spas, and other locations.

In addition to the use of microbubbles to enhance a user's pedicure experience, it would be desirable for a user to be able to use an easily portable microbubble generating device that can be used for various purposes including washing animals such as dogs and other pets. As noted above, it would be beneficial to incorporate microbubbles in the water used to wash the animal so that the animal is thoroughly cleaned, and more dirt and impurities are removed effectively. Existing devices and systems for providing microbubbles are unable to provide such features and are often overly complex and non-portable.

Accordingly, there is still an unsolved need for microbubble generating technology that may address these and other existing issues.

SUMMARY

According to one embodiment, one or more embodiments are provided below for a microbubble generating device adapted to produce microbubbles in water. The microbubble generating device may include a housing having an inlet and an outlet, whereby the inlet is configured to flow incoming water through the inlet in order for the microbubbles produced by the microbubble generating device to be added to the incoming water. One or more openings may be located on the housing, whereby the one or more openings allow air from a surrounding environment of the microbubble generating device to be directed through the one or more openings and into the housing. The microbubble generating device, in one or more non-limiting embodiments, may include one or more conduits configured to direct the air and incoming water within the housing of the microbubble generating device. The microbubble generating device may further include a solenoid valve and a timer, whereby the timer is configured to be control the solenoid valve. The microbubble generating device may further include an air mixing chamber for the air and the incoming water to mix together to form microbubbles, whereby the air mixing chamber further includes an air mixing core member that is disposed within the air mixing chamber and aids in the production of the microbubbles. The microbubble generating device may further include a pump, wherein the pump is configured to pump the air and the incoming water to the air mixing chamber. The outlet of the microbubble generating device may be configured to direct outgoing water from the air mixing chamber, whereby the outgoing water includes the microbubbles.

According to a second embodiment, the present description includes a system for generating microbubbles in a pedicure tub. The system may include the pedicure tub, whereby the pedicure tub is configured for providing a pedicure to a user and for containing water. The pedicure tub may further include an opening located on one side of the pedicure tub. The system may include a tub fitting, whereby the tub fitting is configured to fit in the opening located on the one side of the pedicure tub. The tub fitting may further include a body having an inlet and an outlet, whereby the water in the pedicure tub is configured to flow from the pedicure tub through the outlet of the tub fitting to a microbubble generating device. Further, the microbubbles that are generated using the microbubble generating device are configured to flow into the inlet of the tub fitting and into the pedicure tub. The system may further include one or more filters as well as a first conduit, wherein the one or more filters is connected by the first conduit to the outlet of the tub fitting. The microbubble generating device in the system may include its own inlet and outlet, whereby the first conduit connects the one or more filters to the inlet of the microbubble generating device. The system may further include a second conduit, whereby the second conduit connects the outlet of the microbubble generating device to the inlet of the pedicure tub fitting.

According to another embodiment, the present description may further include a method for generating microbubbles in the water in a tub. The method may include providing the water in the tub and activating a microbubble generating device connected to the tub. The method may further include flowing the water from the tub through a first conduit to one or more filters and then filtering the water from the tub by flowing the water through the filters. The filtered water may then flow through the inlet of the microbubble generating device and to the pump located in the microbubble generating device. The method may further include activating the solenoid valve in the microbubble generating device to open an orifice in a conduit that provides access to air for a first predetermined period of time. The method may further include flowing the air and the water through the pump and to the air mixing chamber located within the housing of the microbubble generating device. The method may further include closing the solenoid valve for a second predetermined period of time while the air and the water are mixing in the air mixing chamber and flowing the air and the water through the air mixing chamber to form the microbubbles. The method may further include flowing the water having the microbubbles from the air mixing chamber through the outlet of the microbubble generating device, and flowing the water having the microbubbles from the microbubble generating device to the tub.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
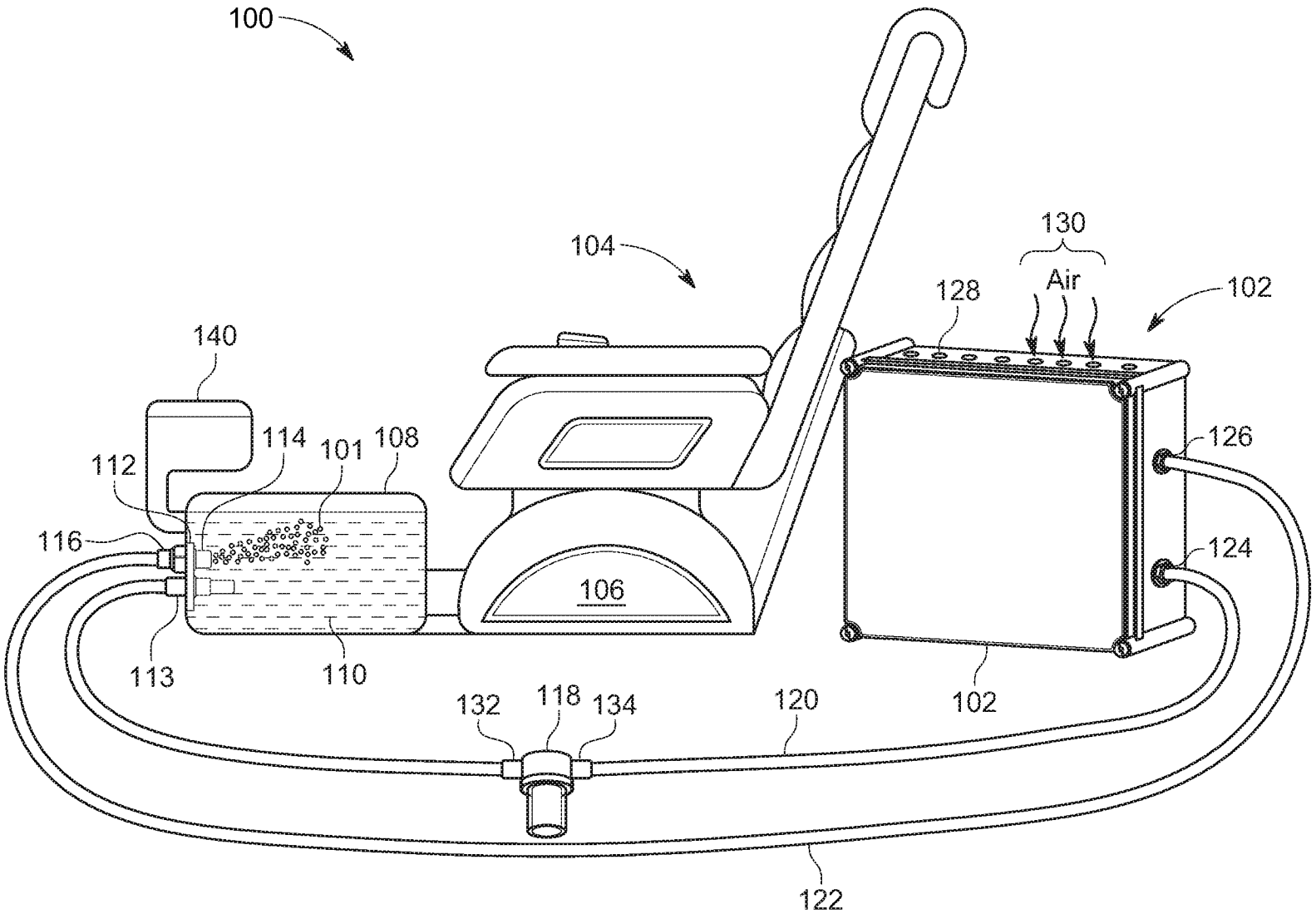
FIG. 1 is a diagram of a system configured to use a microbubble generating device with a pedicure chair and pedicure tub.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "coupled to" as used herein may mean a direct or indirect connection via one or more components.

The present disclosure is generally drawn to various embodiments for microbubble cleaning devices and systems. The use of microbubbles has many known health related and therapeutic benefits. Notably, incorporating microbubbles the bathing or washing of a human or animal has been shown to help increase body circulation and decrease muscle tension. Additionally, microbubbles provided enhanced cleaning of the epidermal layer of a human body or animal body by surrounding the body with negatively charged microbubbles small enough that they can enter the pores of the epidermis and remove dirt and impurities more effectively. In yet another benefit, the microbubbles oxygenate and soften the skin by increasing the dissolved oxygen levels in the water, kill bacteria with its negative ions, and reduce or eliminate the need for excessive use of soap and chemicals in the bath. Microbubbles may further help water retain heat for longer periods of time, which makes a more pleasant bathing or cleaning experience for a human or animal.

In one or more non-limiting embodiments, the present description provides embodiments for a microbubble generating device that makes it possible to include microbubbles in a pedicure tub. In particular, the one or more non-limiting embodiments for a microbubble generating device for a pedicure tub enable existing pedicure tubs to be retrofitted, because the microbubble generating device includes a tub fitting that is sized to fit existing openings in most pedicure tubs (e.g. the openings that are currently used for one or more jets). Accordingly, the user can locate the tub fitting in the existing opening of the pedicure tub, and using the method and system described herein, make the microbubble bathing process available to a customer or user during the pedicure treatment. This is advantageous as many people require pedicures to maintain the health and good appearance of their feet, as well as seek the helpful massage and health benefits provided during the pedicure. The ability to include microbubbles for the customer in any existing pedicure chair or pedicure tub combination enhances the pedicure experience for the customer and improves the pedicure overall by promoting blood circulation and allowing the extra oxygen in the water due to the microbubbles to oxygenate the skin leaving the skin softer.

In addition to the use of microbubbles with pedicures in either a nail salon or spa or other location, it would be desirable to have the same technology available to those who want to incorporate the benefits of using microbubble enhanced water to clean their pets. In particular, it may be beneficial for washing one's dog or other pet. The benefits that are provided to a human using microbubble enhanced water are the same benefits provided to the pet or animal. Namely, as noted above, more dirt, toxins, and impurities are attracted to the microbubbles and thus removed during the washing process, and the overall experience is also very pleasant and relaxing to the animal.

Accordingly, the one or more non-limiting embodiments provided below describe a microbubble generating device, system, and method of use of the microbubble generating device in conjunction with various types of tubs configured to contain water. The embodiments provided herein may be used for multiple purposes, including for pedicures or washing one's pets. Further details are provided below with reference to the Figures.

Turning to FIG. 1, FIG. 1 is a diagram depicting system 100 which is an example of a system for providing microbubbles, such as microbubbles 101, that are generated using a microbubble generating device 102. In one or more non-limiting embodiments, water 110 located in the pedicure tub 108 is routed to the microbubble generating device 102, and then returned having multiple or a plurality of microbubbles 101 to pedicure tub 108. Pedicure tub 108 may be a tub that is suited or adapted for use when providing pedicures to a customer or user. It is noted that the term "tub" as used herein may be interchangeably used with the words "container" or "storage container" which further explain the meaning of the term "tub."

In one or more non-limiting embodiments, pedicure tub 108 may be attached to a pedicure chair such as pedicure chair 104. Alternatively, pedicure tub 108 may not be attached to a pedicure chair 104, but rather be located proximately to the pedicure chair 104 so that it is convenient for a user to sit in pedicure chair 104 with their feet comfortably resting in pedicure tub 108 during portions of the pedicure treatment.

Many pedicure chairs 104 are frequently found in nail salons, spas, gymnasiums, malls, or anywhere where one may receive a pedicure. The customers usually enjoy sitting in pedicure chairs 104 as they may include many features designed to enhance the comfort and relaxation of the user during a pedicure. For example, pedicure chairs 104 may include a wider seat, taller back portion, soft seating material, as well as incorporate or include built in massaging capabilities in the back or seat area. Further, pedicure chairs 104 may recline or extend forward for better positioning of the user during the pedicure. Accordingly, it is common that when a user goes to a location for pedicure, he or she may be seated in a pedicure chair such as pedicure chair 104 and may be able to also place his or her feet on a footrest, such as footrest 140 shown in FIG. 1, attached to and located above the pedicure tub 108. In one or more non-limiting embodiments, pedicure chair 104 may include a base such as base 106. Such bases 106 may be made of any material, but it is noted that it is common for such bases 106 of pedicure chairs 104 to be made from a combination of fiberglass, wood, or plastic. The base 106 may help to support the structure of the pedicure chair 104 and further to conceal certain electrical and structural elements of the pedicure chair 104.

It is noted that pedicure tub 108 may be used in any location suitable to the user. For example, it may be desirable at a salon to locate pedicure tub 108 proximate to a massage bed or the like. Further, pedicure tub 108 may be available for personal and home use in which case pedicure tub 108 may be located in front of any kind of chair or spot conducive to using the pedicure tub 108.

In one or more non-limiting embodiments, pedicure tub 108 is adapted for use for pedicures. Pedicure tub 108 may be a typical tub that has four or more raised sides and a deep basin or reservoir for holding liquids. In particular, pedicure tub 108 may contain water 110. Additionally, any other fragrances, soaps, lotions, or additives may be added to the water 110 as part of the pedicure process. Most pedicure tubs 108 include faucets (not shown) that dispense hot and cold water directly into the pedicure tub 108, whereby the faucets may be positioned conveniently on the pedicure tub 108 or near the pedicure tub 108. The water 110 may be temperature adjustable to make the water 110 hotter or colder to suit the desired temperature for the customer using these faucets. Any other water source other than a faucet may be used to fill pedicure tub 108. Accordingly, pedicure tub 108 may be filled with water 110 in anyway.

Figure 2:
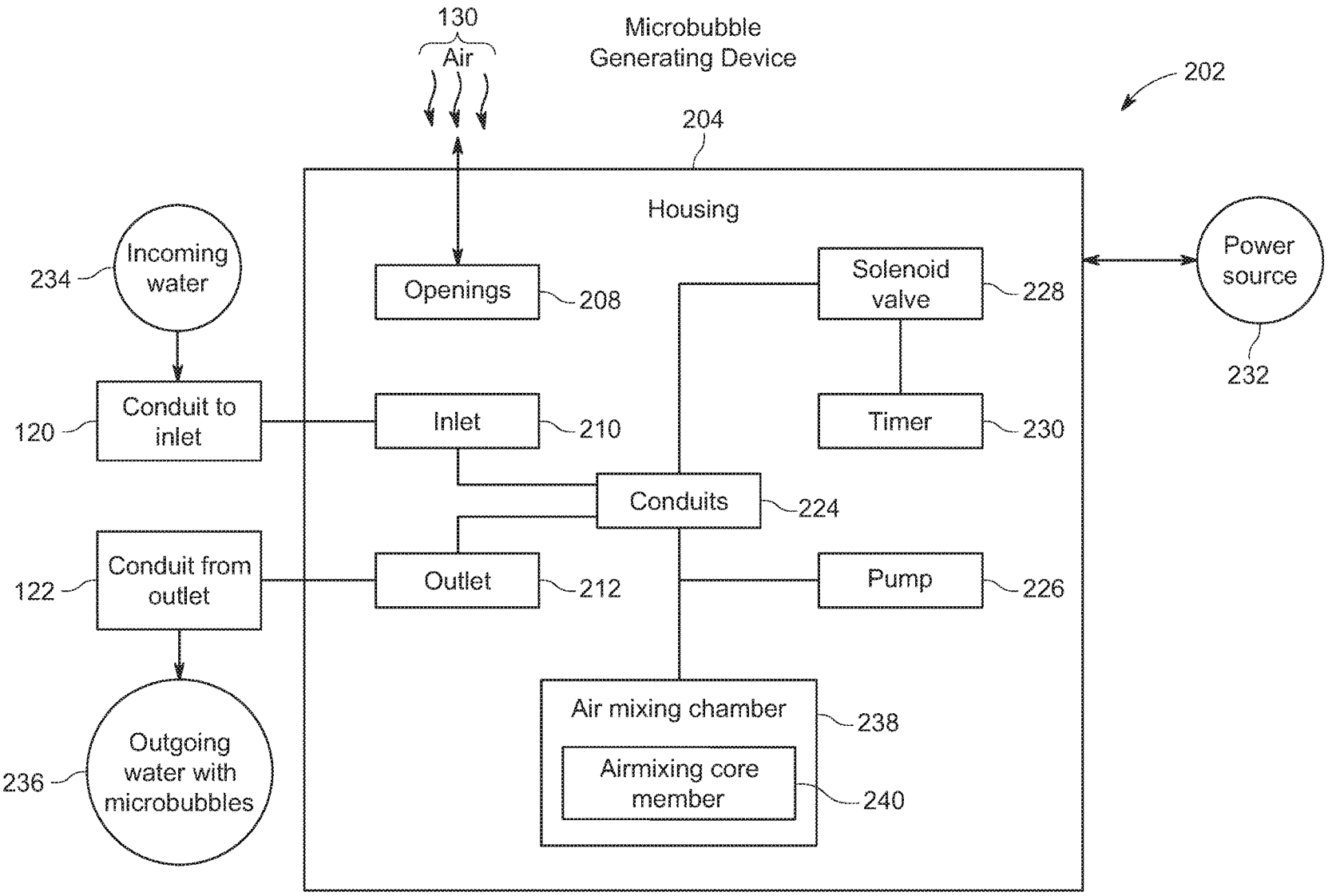
FIG. 2 is a block diagram of a microbubble generating device in accordance with an illustrative embodiment.

In one or more non-limiting embodiments, system 100 includes microbubble generating device 102 which connects to pedicure tub 108 using one or more conduits, such as first conduit 120 and second conduit 122. Microbubble generating device 102 is a unit that includes its own housing (e.g. housing 204 as shown in FIG. 2) that encompasses many electrical and non-electrical components needed to produce microbubbles in the water 110 of the pedicure tub 108. As further explained below with reference to FIG. 2, microbubble generating device 102 may further include, in one or more non-limiting embodiments, one or more openings 128 located in or on one or more surfaces of the microbubble generating device 102. The one or more openings 128 may have multiple functions, including dissipating heat from the microbubble generating device 102 as well as allowing the atmospheric air 130 for generating microbubbles 101 to flow in through the one or more openings 128 in the microbubble generating device 102.

Figure 11:
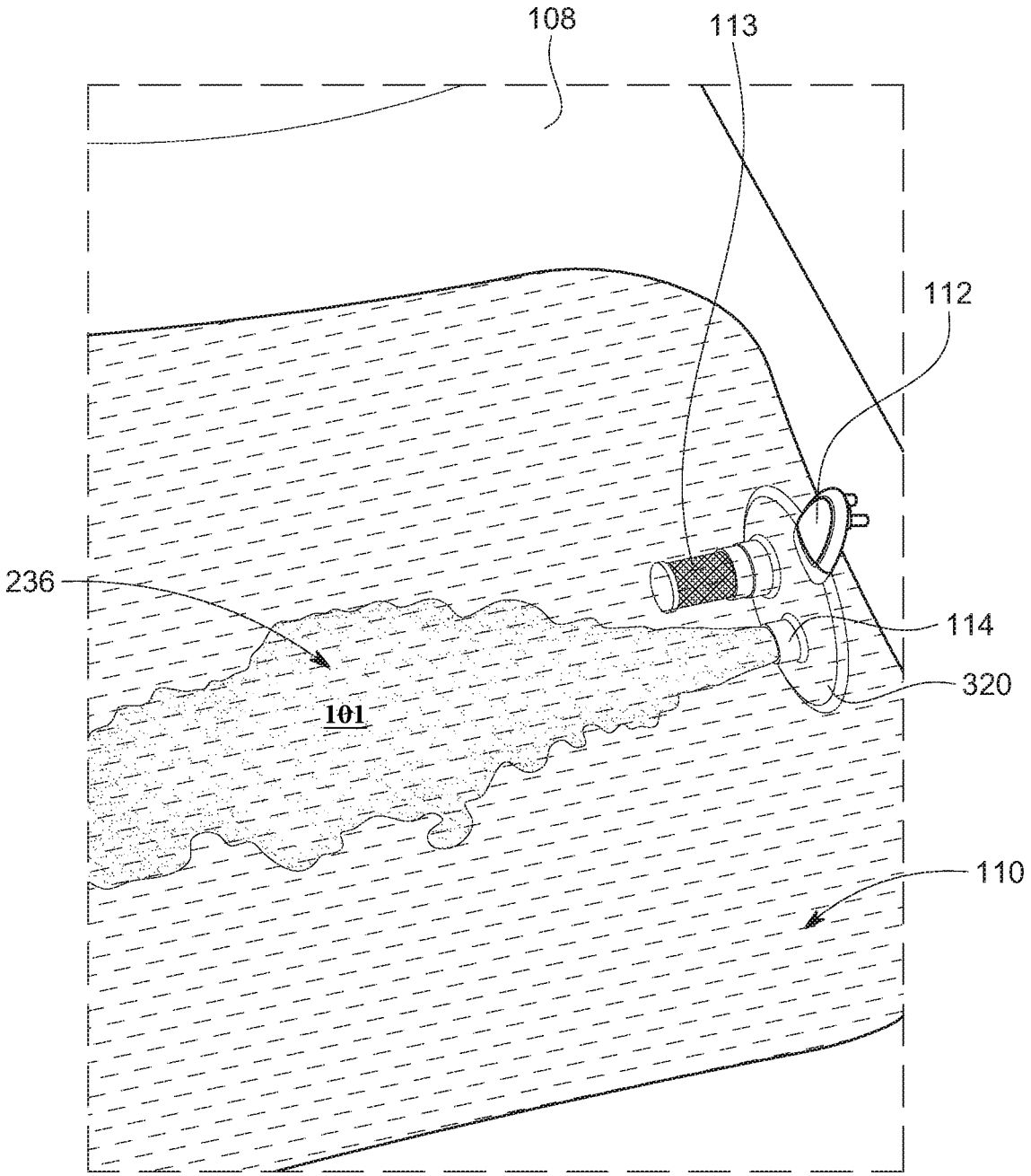
FIG. 11 is a pictorial illustration of a pedicure tub filled with water and microbubbles while in use in accordance with an illustrative embodiment.

Microbubbles 101 are liquid particles that include a gas cavity. The liquid in this case is water and the gas cavity is air (e.g. air 130 as shown in FIG. 1). Microbubbles 101 are typically very small (e.g. 1-100 micrometers in size although other sizes are possible as well). Water 110 may normally be clear colored without the incorporation of microbubbles 101. When microbubbles 101 are directed in water 110 in the pedicure tub 108, the water 110 very quickly becomes a very cloudy, dense, white color so that the water 110 is no longer clear. This change in appearance in the water 110 is an indication that there are many microbubbles 101 and is due to the incorporation of the additional air (and oxygen) in the water 110. FIG. 11 depicts an illustration of pedicure tub 108 that includes the microbubble generating device outgoing water 236 pouring into the pedicure tub 108 and having many microbubbles 101 that were generated by the microbubble generating device 102. As shown in FIG. 11, the device outgoing water 236 poured from the pedicure tub fitting 112 into the pedicure tub 108 causes the clear water 110 in the pedicure tub 108 to be replaced with water having a dense, white cloudy color and composition, whereby the outgoing water 236 includes many microbubbles 101. The original water 110 is continuously replaced with outgoing water 236 containing microbubbles 101 as long as the microbubble generating device 102 (and 202 as shown in FIG. 2 and throughout the description) is activated and powered on.

As long as microbubble generating device 102 is activated or powered on, the microbubbles 101 will be present in the water 110 in the pedicure tub 108 as indicated by the white, cloudy, dense areas of the water 110. Once the microbubble generating device 102 is deactivated or powered off, then the microbubbles 101 will dissolve and dissipate returning the water 110 to its previous clear color and composition.

In one or more non-limiting embodiments, pedicure tub 108 includes a pedicure tub fitting 112. The components of pedicure tub fitting 112, according to one or more non-limiting embodiments, are described further in association with FIG. 3 and FIG. 4. It is noted that pedicure tub fitting 112 may be interchangeably referred to herein as a "tub fitting". Pedicure tub fitting 112 is a fitting that is designed to fit into a hole or opening in a side wall of pedicure tub 108. Pedicure tub fitting 112 is configured to include an inlet 113 that directs the existing water 110 from the pedicure tub 108. Pedicure tub fitting 112 further includes outlet 114. In one or more non-limiting embodiments, water which includes a plurality of microbubbles 101 (e.g. outgoing water 236 as shown in FIG. 2) is returned to pedicure tub 108 from microbubble generating device 102 through the outlet 114 of the pedicure tub fitting 112. Further, in one or more non-limiting embodiments, pedicure tub fitting 112 is configured to include an aerator assembly, such as aerator assembly 116 which assists in producing finer or smaller sized microbubbles 101. Aerator assembly 116 is further discussed below with reference to FIG. 5.

Pedicure tub fitting 112, as shown in FIG. 1, is located or positioned on one side wall of the pedicure tub 108. In FIG. 1, pedicure tub fitting is shown on the wall of the pedicure tub 108 opposite the front of the pedicure chair 104. It is noted that pedicure tub fitting 112 may be located on any of the side walls of the pedicure tub 108, but for convenience it may be desirable to position the pedicure tub fitting 112 on either the side wall of the pedicure tub 108 closest to the front of the pedicure chair 104 or just directly opposite the front of the pedicure chair 104 (e.g. as shown in FIG. 1).

Advantageously, pedicure tub fitting 112 is a fitting that may enable nail salon owners or other entities that own pedicure chairs 104 and pedicure tubs 108 to retrofit the pedicure tub 108 such that it is not required to purchase brand new pedicure tubs 108 or pedicure chairs 104. Rather, the system 100 incorporates pedicure tub fitting 112 and microbubble generating device 102 so that the nail salon owners or other entities may continue to use their existing pedicure chairs 104 and pedicure tubs 108, but with the added appeal offered to their customers who seek the benefits of including microbubbles 101 during their pedicures. It is also possible for pedicure tubs 104 and/or pedicure chairs 104 to be obtained that are not retrofitted, but rather include pedicure tub fitting 112 and microbubble generating device 102 when purchased from a manufacturer or seller as new purchases.

Most pedicure tubs 104 currently include a designated opening or hole on a side wall of the pedicure tub 108 for a jet. The standard diameter of such designated openings or holes for including such jets in most pedicure tubs 108 are about 3.5 inches in diameter, although other diameters are possible. It is noted that the faucets used to pour hot and cold water 110 into the pedicure tub 108 are usually separately located on pedicure tub 108 from the one or more jets and these designated openings or holes located in the side walls for the jets.

Conventional pedicure tubs 108 use jets help to circulate the water in the pedicure tub 108 so that the water moves quickly around the feet of the customer creating a whirlpool effect and massaging the feet of the customer. A jet that is commonly used is a magnetic jet, although other jets may be used as well other than magnetic jets in most existing pedicure tubs (e.g. pedicure tub 108). In one or more non-limiting embodiment, pedicure tub fitting 112 may replace these jets and by doing so, the owner of the pedicure tub 108 is able to retrofit their pedicure tub 108 to enable the pedicure tub 108 to contain microbubble enriched water 110.

In most existing or conventionally available pedicure tubs 108, a jet is usually positioned on one of the upright walls of the pedicure tub 108. The jet is usually a circular disk that includes holes and water 110 flows through the holes of the jet into the pedicure tub 108. It is common for such jets to be referred to as magnetic jets. Magnetic jets include a couple of components as part of its assembly. The jet portion may be attached to a motor that sits on the outside of the pedicure tub 108 over the hole for this jet. The jet and motor may be fixedly attached to the outside of the pedicure tub 108.

During pedicures, it is common for sanitization purposes for the pedicure technician to use a disposable plastic liner for each customer during a pedicure. Accordingly, the pedicure technician places the disposable plastic liner over the sides of the pedicure tub 108 and in the center. Any water 110 that fills the pedicure tub 108 fills over the disposable liner which has strategically created holes for the position of the jet and the drain of the pedicure tub 108. A magnetic jet has a top magnet component that allows the pedicure technician to place the top component of the magnetic jet over the hole of the plastic liner, and the top component of the magnetic jet connects magnetically or through other clips to the back portion of the jet so that the water 110 from the jet can pour into the disposable plastic liner and the pedicure tub 108 directly.

In one or more non-limiting embodiments, the dimension and shape of pedicure tub fitting 112 enables the pedicure tub fitting 112 to replace the existing jet located in a pedicure tub 108. Accordingly, the owner of the pedicure tub 108 or other entity may remove the existing jet, which should provide access to the underlying hole or opening in the pedicure tub 108 and replace the jet with the pedicure tub fitting 112 instead. As noted above, such hole or opening tends to be a standard diameter size of about 3.5 inches. Accordingly, pedicure tub fitting 112 may have a diameter of approximately 3.5 inches to fit in this standard size designated opening in pedicure tube 108. However, one of ordinary skill in the art understands that other sizes may also be possible and pedicure tub fitting 112 may be sized as needed. The owner of the pedicure tub 108 or other entity may remove a jet (including a magnet jet) and the relevant components from the pedicure 108, and replace that jet with the pedicure tub fitting 112 in this designated location to retrofit the pedicure tub 108 or to otherwise enable the pedicure tub 108 to include microbubbles 101 in the water 110 as generated by the pedicure generating device 102.

In addition, system 100 may include conduits 120 and conduits 122 as shown in FIG. 1. Conduit 120 may be attached or otherwise connected to the inlet 113 of the pedicure tub fitting 112. Conduit 120 transports the water 110 from pedicure tub 108 towards the microbubble generating device 102. Initially, when the water 110 is first poured in the pedicure tub 108, this water 110 may not include any or only a negligible amount of microbubbles 110. Conduit 120 acts as a conduit to transport the water 110 to microbubble generating device 102. Conduit 122 acts as a conduit to transport the water that has been infused with microbubbles 101 after circulating through microbubble generating device 102 back to the pedicure tub 108. The term "conduit" as used herein may refer to a pipe, tube, or other component capable of carrying fluid. The conduits described throughout (including conduits 120 and 122) have bores or passageways inside their generally cylindrical bodies with an opening on each end to allow the fluid (e.g. water 110) to be carried through the conduits.

In one non-limiting embodiment, a filter, such as filter 118 may be located along conduit 120. Filter 118 may filter out any unwanted elements from water 110 as it comes from pedicure tub 108 and travels to microbubble generating device 102. Filter 118 acts to filter out impurities or unwanted elements from water 110 in order to clean and sanitize the water 110 to avoid recirculating these undesirable elements back to the pedicure tub 108 as well as to avoid such unwanted elements from building up within the microbubble generating device 102. Advantageously, filter 118 may filter out undesirable elements such as dirt, skin, nail clippings, hair, large pieces of soap or sugar scrubs, or any other elements that commonly end up in water 110 during a pedicure. In one non-limiting embodiment, the filter 118 is advantageously located externally from the microbubble generating device 102 which makes it easier for the pedicure technician or another person to change and clean out the filter 118 regularly. It is also possible for filter 118 to be located internally within microbubble generating device 102. Additionally, there may be more than one filter 118 located along conduit 120 or conduit 112 so that there may be two or more filters 118 along conduit 120 and conduit 122. Alternatively, a filter 118 may be located along conduit 120 and also internally within the microbubble generation device 102 in other alternative embodiments. In one or more non-limiting embodiments, filter 118 may be a two-screen type of filter, although any other type of filter 118 may be used as well. As noted above, it is beneficial to place filter 118 externally from microbubble generating device 102 in such a manner that it is accessible for quick cleaning and/or replacement.

Filter 118 may be configured to connect to conduit 120 whereby filter 118 includes a filter inlet 132 and a filter outlet 134 whereby conduit 120 can connect to both the inlet 132 and outlet 134 of filter 118. It is noted that the configuration depicted in FIG. 1 is non-limiting as filter 118 may also be placed much closer to inlet 113 of pedicure tub fitting 112. Filter 118 may further be coupled closer to inlet 124 on conduit 120 in alternative embodiments.

After water 110 passes through filter 118 from pedicure tub 108, the water 110 may travel to the inlet 124 of microbubble generating device 102. After circulating through the system components within the microbubble generating device 102, the water 110 is released through the outlet 126 of microbubble generating device 102 having a plurality of microbubbles 101 and returned through conduit 122 to pedicure tub 108. Conduit 122 may be connected at the opposite end from outlet 126 to the outlet 114 of the pedicure tub fitting 112.

In one or more non-limiting embodiments, the water 110 that has been circulated through microbubble generating device 102 passes through the return conduit 122 into the aerator assembly 116 and then into pedicure tub 108 through the inlet 114 of the pedicure tub fitting 112. The microbubbles 101 are dispersed throughout the water 110 of the pedicure tub and continuously replenished as long as the microbubble generating device 102 is activated or powered on. Accordingly, the customer may enjoy a pedicure while sitting in a chair, such as a pedicure chair 104 and their feet located in pedicure tub 108 that includes the microbubbles 101.

As shown in FIG. 1, in one or more non-limiting embodiments, microbubble generating device 102 may be coupled to the pedicure chair 104. Accordingly, microbubble generating device 102 may be removably or permanently attached to pedicure chair 104. In one or more non-limiting embodiments, microbubble generating device 102 may be conveniently attached to or within base 106 of pedicure chair 104. In a preferred embodiment, the microbubble generating device 102 may be located within the base 106 under the pedicure chair 104.

Microbubble generating device 102 may be attached using fasteners, adhesives, or any other means of attachment known in the art. Alternatively, microbubble generating device 102 may be attached to another structure other than pedicure chair 104 if so desired. Additionally, microbubble generating device 102 is also capable of being freestanding without being attached to pedicure chair 104 or another structure and may be located proximate to the pedicure tub 108 as a free-standing unit. Advantageously, microbubble generating device 104 may be relatively lightweight and portable so that microbubble generating device 104 may be easily moved from place to place.

It may be advantageous for microbubble generating device 104 to be closely rather than remotely located from pedicure tub 108 so as to minimize the amount of pressure needed to cause the water 110 to travel through the conduit 120, microbubble generating device 102, conduit 122 and back to the pedicure tub 108. Accordingly, it is recommended that microbubble generating device 102 be located proximate to the pedicure tub 108 and pedicure chair 104 when used for such a purpose.

Figure 16:
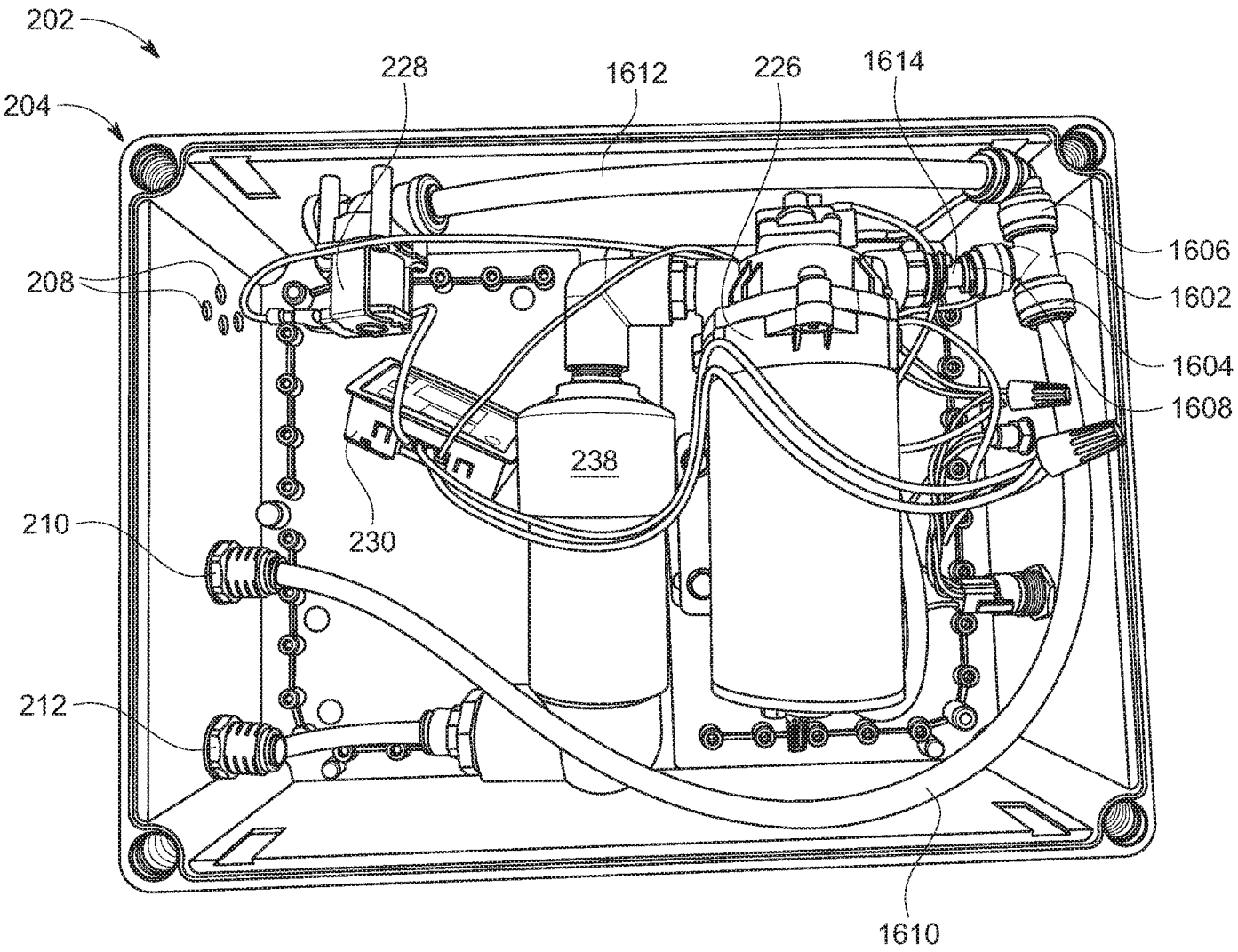
FIG. 16 is a pictorial illustration of an interior view of a microbubble generating device in accordance with an illustrative embodiment.

Turning to FIG. 2 and FIG. 16, FIG. 2 is a block diagram depicting one or more exemplary components of a microbubble generating device, such as microbubble generating device 202. It is noted that microbubble generating device 202 is in accordance with microbubble generating device 102 as pictured and described above in FIG. 1. Accordingly, microbubble generating device 202 may function in accordance with the description of microbubble generating device 101 in FIG. 1 and vice versa.

Microbubble generating device 202 may be a single unit that has its own housing 204. As shown in FIG. 1, in one embodiment, microbubble generating device 202 (i.e. microbubble generating device 102) has a box like housing 204 although other shapes and configurations are possible as well. In one non-limiting embodiment, the housing 204 of the microbubble generating device 202 may be approximately 11-12 inches high by 14-15 inches wide and 5-6 inches deep. One of ordinary skill in the art understands that such figures are exemplary only and that the microbubble generating device 202 may be manufactured having any range of dimensions.

In one non-limiting embodiment, microbubble generating device 202 includes inlet 210 and outlet 212. Inlet 210 of microbubble generating device 202 may be in accordance with inlet 124 and outlet 126 as shown in FIG. 1. Inlet 210 of microbubble generating device 202 may connect to one end of a conduit (e.g. conduit 120 as shown in FIG. 1 and FIG. 2) that is configured to transport incoming water 234 to the inlet 210 of microbubble generating device 202. The incoming water 234 may have first passed through a filter, such as filter 118, shown in FIG. 1 prior to entering microbubble generating device 102 so as to remove any undesirable elements prior to traveling through the components of microbubble generating device 102. Further, outlet 212 of microbubble generating device 202 may connect to one end of a conduit (e.g. conduit 122 as shown in FIG. 1 and FIG. 2) to direct outgoing water 236 having microbubbles such as microbubbles 101 to pedicure tub 108.

Microbubble generating device 202 may include multiple air openings 208 located anywhere on a surface of microbubble generating device 202. Openings 208 may function and act in accordance with openings 128 as shown and described with respect to FIG. 1. Accordingly, openings 208 may act to allow air 130 from the atmosphere or surrounding environment around microbubble generating device 202 to enter the housing 204 of microbubble generating device 202 through openings 208. Further, openings 208 may allow any heat generated by one or more components within the microbubble generating device 202, such as pump 226 or solenoid valve 228, to dissipate through the openings 208 and to keep the device from overheating. Openings 208 may have any shape or form as desired. In one non-limiting embodiments, openings 208 may be a series of holes or slits but in either a top or side surface of microbubble generating device 202. However, this is a non-limiting example as other configurations are contemplated and within the scope of the present invention as well.

There may be several conduits 224 that are interconnected within the microbubble generating device 202 and that connect one or more components shown in FIG. 2. As noted above, conduits 224 may be pipes or tubes capable of transporting fluids and gases such as water and air. For example, a conduit 224 may connect from inlet 210 of microbubble generating device 202 and may route the incoming water 234 to pump 226.

Figure 10:
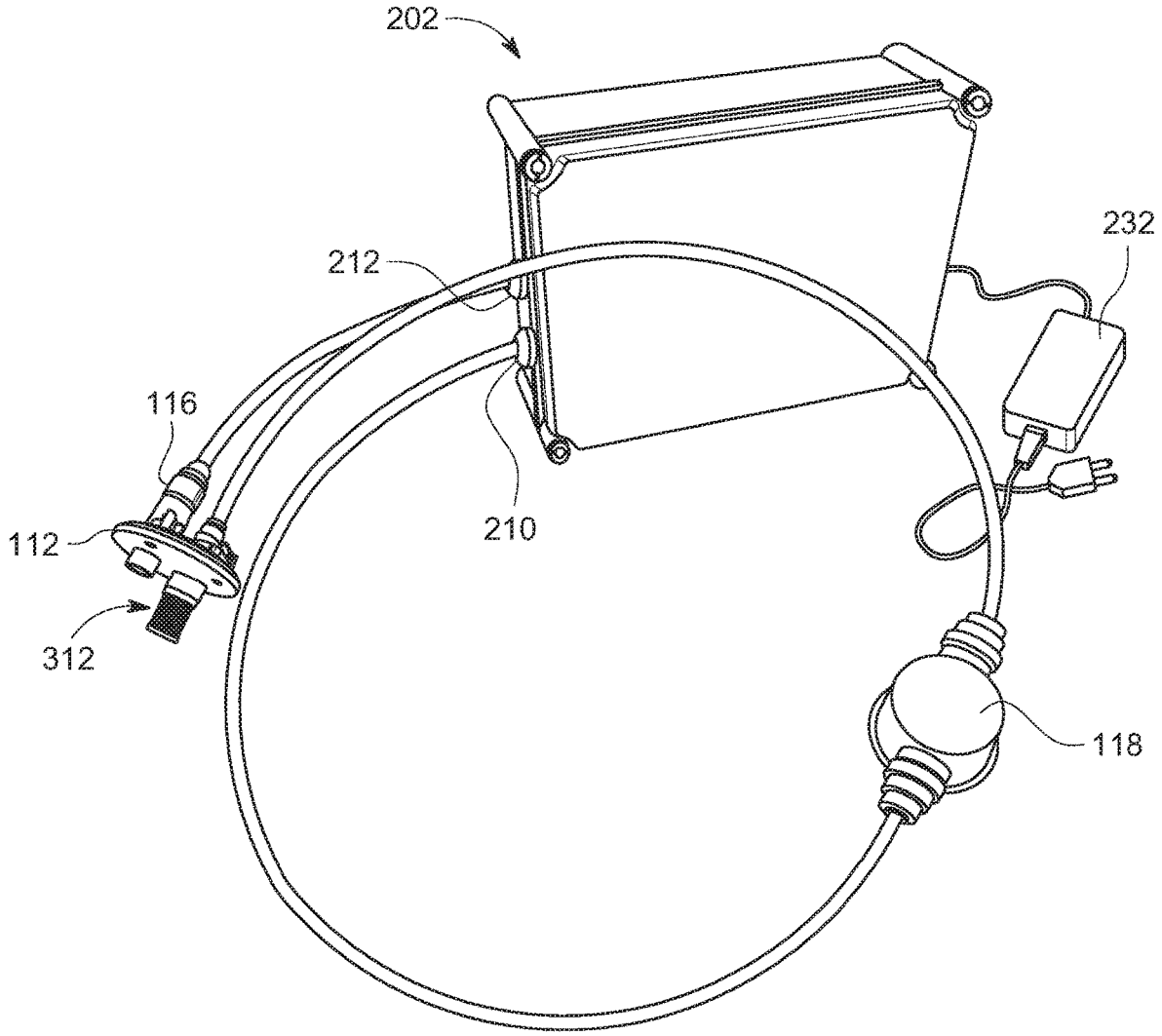
FIG. 10 is a pictorial illustration of a microbubble generating device for a pedicure tub in accordance with an illustrative embodiment.

Pump 226 may be any type of pump known in the art. In a preferred embodiment, pump 226 may be a diaphragm pump. A diaphragm pump is also known as a booster pump. In an additional preferred embodiment, the pump 226 may operate using a 24 volt direct current (24 VDC). Pump 226 may draw in and move fluids such as air 130 and water 110 throughout system 100 and help with the flow of the fluids throughout system 100. More specifically, air 130 and water 110 may be drawn into and out of pump 226 due to differences in pressure. In one or more non-limiting embodiments, pump 226 may be electrically powered by power source 232. In a preferred embodiment, power source 232 may be the electricity provided by an electrical outlet. Accordingly, microbubble generating device 202 may include an electrical power cord (e.g. as shown in FIG. 10) that is connectable to the housing 204 of microbubble generating device 202. Alternatively, or additionally, the power source 232 may be in the form of batteries that may provide power to microbubble generating device 202 and the electrical components within.

Activating microbubble generating device 202 may cause pump 226 to be activated. When pump 226 is powered while located within the housing of microbubble generating device 202, pump 226 may cause the water 110 and incoming air 130 to circulate throughout the microbubble generating device 202 (e.g. via conduits 224) and to and from the pedicure tub 108 (e.g. through conduit 120 and conduit 122). Accordingly, microbubble generating device 202 may include an on/off power button on the side of the housing in one or more non-limiting embodiments.

In one or more non-limiting embodiment, incoming water 234 routed to travel through pump 226 may travel through an inlet and outlet of pump 226 via one or more conduits 224. The incoming water 234 may be routed to air mixing chamber 238. Air mixing chamber 238 is further described and shown in FIGS. 6-9. Air mixing chamber 238 acts as a chamber for mixing air 130 and incoming water 234 together to produce microbubbles 101 that will be routed with the outgoing water 236 to the pedicure tub 108. In one or more non-limiting embodiments, air mixing chamber 238 may further include an air mixing core member 240, an example of which is shown in FIGS. 7-9, and further discussed below.

Microbubble generating device 202 may further include a solenoid valve, such as solenoid valve 228 within the housing 204 of microbubble generating device 202. Solenoid valve 228 may be a type of electromechanically operated valve. Solenoid valve 228 in microbubble generating device 202 may function to open and close an orifice in a conduit, such as conduit 224, that allows air 130 to travel through the pump 226 and to air mixing chamber 238. The opening and closing of solenoid valve 228 may be controlled using timer 230. Timer 230 may be an electrical or digital timer that acts to open solenoid valve 228 for a first predetermined amount of time and close solenoid valve 228 for a second predetermined amount of time. Solenoid valve 228 and timer 230 may both receive their power from power source 232 which is coupled to microbubble generating device 202.

In one or more non-limiting embodiments, solenoid valve 228 is attached or otherwise connected to a conduit 224 that draws in air 130, and timer 230 is connected to solenoid valve 228 to control the opening and closing of the orifice to this conduit 224. Once the air 130 is drawn towards pump 226, the air 130 may be mixed with the incoming water 234 to the air mixing chamber 238. In one or more non-limiting embodiments, it may be desirable to open solenoid valve 228 for a first pre-determined period of time and then to close the solenoid valve 228 for a second pre-determined period of time. For example, the solenoid valve 228 may be opened for 20 seconds to allow air 130 through and then closed for 60 seconds while the air 130 and incoming water 234 mix together within the air mixing chamber 238 and the microbubbles 101 begin to form within the air mixing chamber 238. One of ordinary skill will recognize that other amounts of time may be used instead of the 20 seconds for the first predetermined period of time and 60 second for the second predetermined amount of time and that these are intended to be non-limiting examples.

Once the air 130 and incoming water 234 have been mixed together within the air mixing chamber, the water that leaves the air mixing chamber 238 should become the outgoing water 236 having microbubbles 101 and may be routed through the outlet 212 of the microbubble generating device 202 back through an outgoing conduit (e.g. conduit 122).

Prior to flowing the outgoing water 236 having microbubbles 101 into pedicure tub 108, it may be necessary to pass the outgoing water 236 through an aerator assembly such as aerator assembly 116 (e.g. as shown in FIG. 1) which is further described below with respect to FIG. 5. Aerator assembly 116 may be coupled to one end of the outgoing conduit 122 and may be coupled at another end to the pedicure tub fitting 112.

In one or more nonlimiting embodiments, maintenance of microbubble generating device 202 is relatively easy because the housing 204 of the microbubble generating device 202 may include one or more panels that may be removed for easy access to an interior of the housing 204. If the components need to be maintained or repaired or replaced, it may be possible to do so by removing one or more panels of housing 204.

Turning to FIG. 16, FIG. 16 may illustrate an example of the arrangement of one or more components of microbubble generating device 202 as described above and as shown in FIG. 2. FIG. 16 is a pictorial illustration showing an interior view of one or more components of microbubble generating device 202 within the housing 204 of microbubble generating device 202. As shown in FIG. 16, the housing 204 of the microbubble generating device 202 may have any number of openings 208 for allowing air in through the housing 204 as well as for dissipating heat. The location of openings 208 in FIG. 16 is exemplary and non-limiting as openings 208 may be located anywhere on housing 204 of microbubble generating device 202. It is noted that the microbubble generating device 202 may not necessarily need to include openings 208 as the air located within the housing 204 of the microbubble generating device 202 may be used to circulate into the conduit (e.g. conduit 1612 as shown in FIG. 16) transporting air 130 to the pump 226 and air mixing chamber 238.

FIG. 16 further shows examples of inlet 210 and outlet 212 of microbubble generating device 202. Inlet 210 is shown having a conduit, such as conduit 1610 attached to the inlet 210. In operation, conduit 1610 is configured to transport incoming water 234 within the interior of the housing 204 of the microbubble generating device 202. This incoming water 234 is directed towards the pump 226 located within the housing 204 of the microbubble generating device 202 and shown in FIG. 16. As noted above, the incoming water 234 is provided from a tub, such as tub 108 shown in FIG. 1 which needs to be infused with microbubbles that may be created within the air mixing chamber 238.

In one or more non-limiting embodiments, microbubble generating device 202 may include a tee connector, such as tee connector 1602 as shown in FIG. 16. Tee connector 1602 is a type of connector shaped like a "T" and may also be referred to as a three port connector because it has three ports, namely, port 1604, port 1606, and port 1608. As shown in FIG. 16, a conduit, such as conduit 1610 can connect to one port 1604 of tee connector 1602. Another conduit, such as conduit 1612 can connect to another port 1606 of tee connector 1602, while a third conduit 1614 may connect to a third port 1608 of tee connector 1602. Conduits 1610, 1612, and 1614 may be in accordance with conduits 224 as shown in FIG. 2 and discussed above.

As shown in FIG. 16, in one or more non-limiting embodiments, the solenoid valve 228 is connected to conduit 1612 which connects to port 1606 of tee connector 1602. In a non-limiting embodiment, conduit 1612 may be a conduit through which air 130 is directed to the port 1606 of tee connector 1602. The solenoid valve 228 may be attached to one end of conduit 1612 and may control the opening and closing of an orifice inside of conduit 1612 as noted above for pre-determined periods of time.

The tee connector 1602 functions as a connector whereby the incoming water 234 can travel through the first port 1604 of the tee connector 1602, the air 130 can travel through a second port 1606 of the tee connector 1602, and then mix together and travel into an inlet of pump 226 through the third port 1608 of the tee connector 1602. The inlet of pump 226 may be aligned with port 1608 of tee connector 1602 and conduit 1614 in order to allow the directed air 130 and incoming water 234 to travel through pump 226 and into the air mixing chamber 238 for mixing as shown in FIG. 16. Further, information is provided below about air mixing chamber 238 in reference to FIGS. 6-9.

FIG. 16 further illustrates timer 230 connected to solenoid valve 228, whereby timer 230 controls the opening and closing of solenoid valve 228 for the pre-determined periods of time. Namely, the solenoid valve 228 may be regulated by timer 230 to open for a first pre-determined period of time when air 130 travels through conduit 1612 and to close when the mixture of the air 130 and incoming water 234 are mixed within the air mixing chamber 238 for a second pre-determined period of time as noted above.

Microbubble generating device 202 as shown in the block diagram of FIG. 2 is not limited to the illustrated components as one or more components may be removed, while other components not shown may be added. In particular, additional elements may be added that assist in the distribution of electrical power to the various components, such as the pump 226, solenoid valve 228, and timer 230 as well as various other elements which have been omitted for purposes of simplification, but which would be understood by one of ordinary skill in the art.

Figure 3:
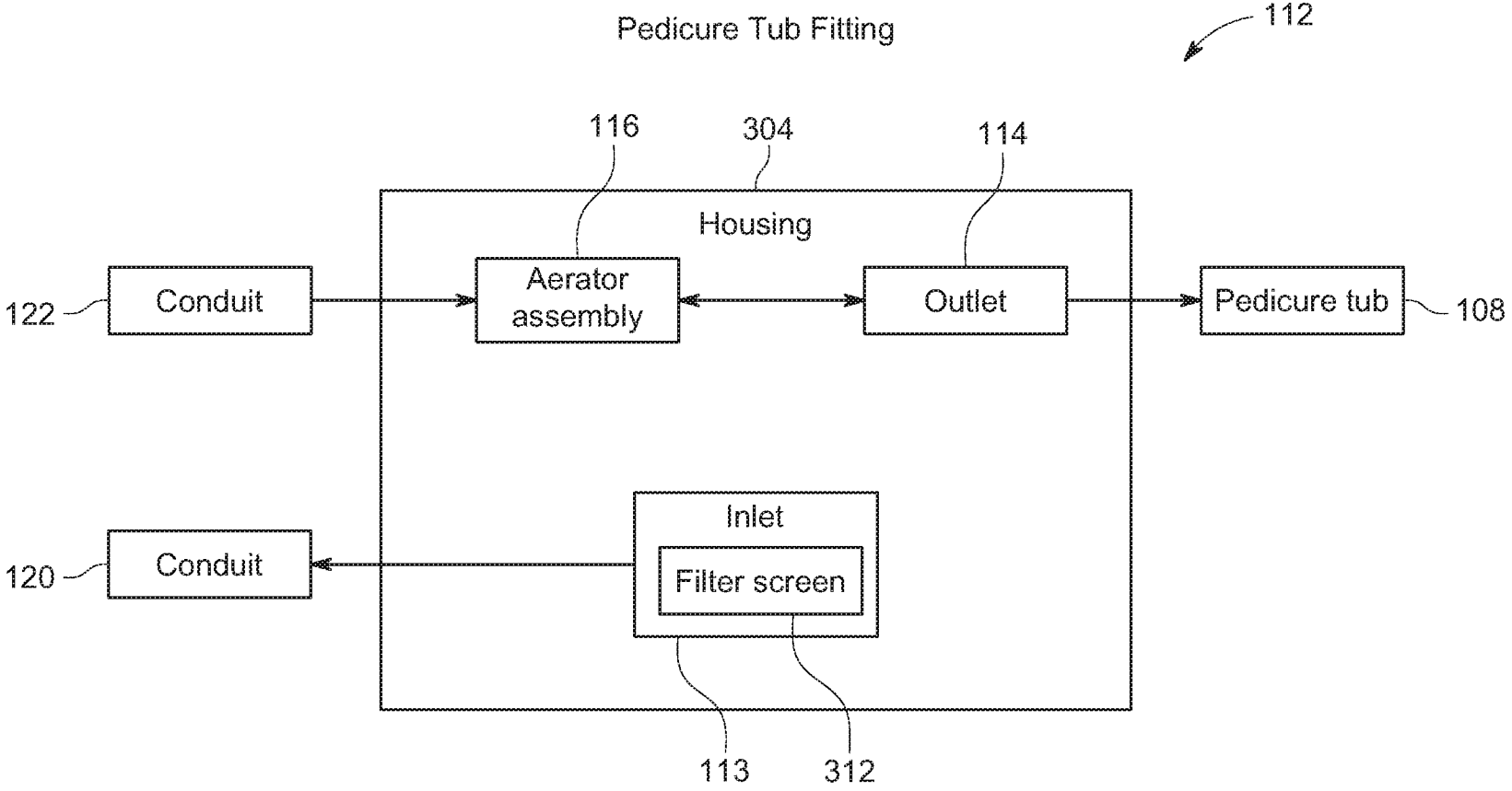
FIG. 3 is a block diagram of a pedicure tub fitting in accordance with an illustrative embodiment.
Figure 4:
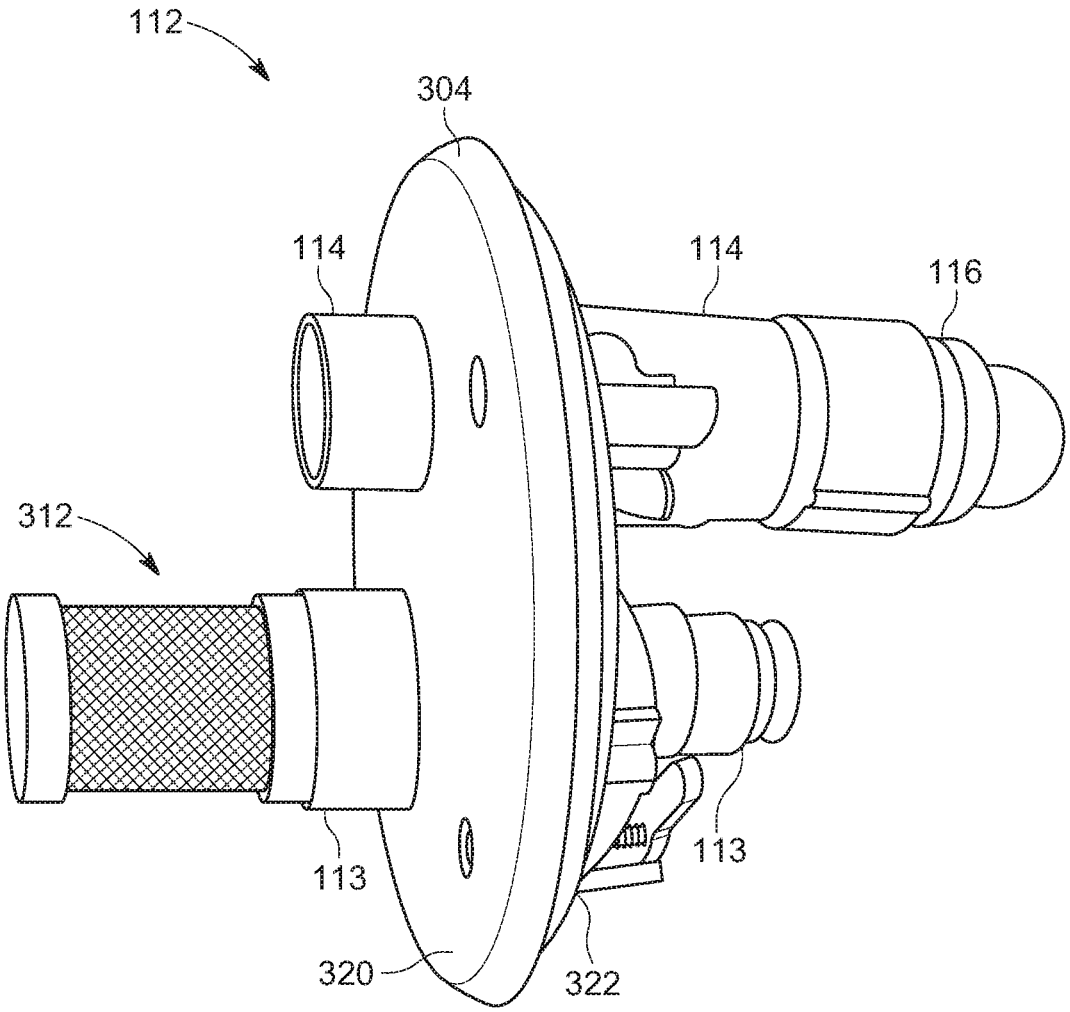
FIG. 4 a pictorial illustration of a pedicure tub fitting in accordance with an illustrative embodiment.

Turning to FIG. 3 and FIG. 4, FIG. 3 is a block diagram depicting exemplary components of a pedicure tub fitting 112 and FIG. 4 is a pictorial illustration of pedicure tub fitting 112 according to a non-limiting embodiment. Pedicure tub fitting 112 in FIG. 3 and FIG. 4 may include housing 304. The housing 304 of pedicure tub fitting 112 may include an inlet 113 and an outlet 114. Inlet 113 may be a port through which water 110 is drawn out from the pedicure tub 108 shown in FIG. 1 to the microbubble generating device 102 in order to infuse the water 110 with microbubbles 101. Outlet 114 may be the port through which the microbubble infused water 236 is directed into pedicure tub 108. It may be beneficial for the water level of the water in the pedicure tub 108 to be kept above the inlet 113 and outlet 114 of the pedicure tub fitting 112 as shown in FIG. 1 so that the water 110 may continuously travel through the inlet 113 of the tub fitting 112 and be returned through the outlet 114 of the tub fitting 112.

In one non-limiting embodiment, housing 304 of pedicure tub fitting 112 may be a circular disk or plate as shown in FIG. 4. The circular shape of the housing 304 of pedicure tub fitting 112 may be advantageous because the pedicure tub fitting 112 may replace the circular jets located in most existing pedicure tubs 108. In this manner, the pedicure tub fitting 112 may be used to retrofit the pedicure tub 108 to make it usable with the microbubble generating device 102. The circular plate housing 304 may include a front surface, such as front surface 320 shown in FIG. 4 and a back surface, such as back surface 322 as shown in FIG. 4. The inlet 113 may be a type of port or conduit that extends from the front surface 320 through the body of the circular plate housing 304 to the back surface 322 of the circular plate housing 304. Similarly, the outlet 114 may be a type of port or conduit that extends from the front surface 320 through the circular plate housing 304 to the back surface 322.

In one or more non-limiting embodiment, the circular plate housing 304 of the pedicure tub fitting 112 may be 3½ inches in diameter, because this is the standard diameter size of most jets located in a pedicure tub 108 as discussed already above. In any case, regardless of the diameter size, the pedicure tub fitting 112 may be sized to fit in such an opening located on one side wall of pedicure tub 108. Alternatively, it may be possible that pedicure tub fitting 112 is located on a bottom surface or other surface of pedicure tub 108.

Pedicure tub fitting 112 may be inserted into a corresponding hole or opening in pedicure tub 108. In one or more non-limiting embodiments, pedicure tub fitting 112 may be made of a combination of rubber, plastic, silicone or any other type of material. In one or more non-limiting embodiments, pedicure tub fitting 112 may include a front surface 320 having a wider diameter than the back surface 322 of the pedicure tub fitting, whereby the front surface 320 reduces in diameter towards the back surface 322 so that when the pedicure tub fitting 112 is inserted in the corresponding hole in pedicure tub 108 (e.g. in the same location where a jet usually is positioned in the pedicure tub 108) the pedicure tub fitting 112 fits snugly in place. In other words, the pedicure tub fitting 112 may act as a seal to prevent water from spilling through the sides of the corresponding hole in the pedicure tub 108. Any additional sealant or other fixing liquid may be used to seal the pedicure tub fitting 112 in place. Additionally, the pedicure tub fitting 112 may be held in place against the pedicure tub 108 using one or more fasteners, adhesives, a combination thereof, or any other means for attachment known in the art.

In one or more non-limiting embodiments, inlet 113 may include a filter screen such as filter screen 312 depicted in the block diagram of FIG. 3 and shown in the pictorial illustration in FIG. 4. The filter screen 312 may be an additional filter that acts to filter out unwanted elements from circulating through the microbubble generating device 202, which may include hair, skin, cleaning elements such as sugar scrubs or sand, as well as other undesirable elements. Filter screen 312 may be replaceable such that filter screen 312 may be easily replaced for each customer or sanitized and cleaned in between each use. In one or more non-limiting embodiments, filter screen 312 may be considered the primary filter and filter 118 may be considered the secondary filter. This may be because filter screen 312 initially catches much of the unwanted elements such as hair, skin, or anything else before the water 110 exiting from the pedicure tub 108 travels to the second filter 118.

In one non-limiting embodiment, the filter screen 312 may be inserted within the bore of inlet 113 of tub fitting 112 in order to filter out any items that may block the microbubble generating device 202. More specifically, the filter screen 312 may be located in the front side of inlet 113 and extends from the front surface 320 of pedicure tub fitting 112 as shown in FIG. 4. The opposite end of the inlet 113 that extends from the back surface 322 of the pedicure tub fitting 112 may connect to one end of a conduit that will transport the water 110 to the microbubble generating device 102, such as conduit 120 as shown in FIG. 1 and FIG. 3.

In one or more non-limiting embodiments, the outlet 114 may be coupled to an aerator assembly 116. Aerator assembly 116 acts to produce finer or smaller sized microbubbles 101 in the water being poured back into pedicure tub 108 through outlet 114. In one or more non-limiting embodiments, as shown in FIG. 4, aerator assembly 116 may be coupled to the back of the outlet 114 as outlet 114 protrudes from the back surface 322 of pedicure tube fitting 112.

Figure 5:
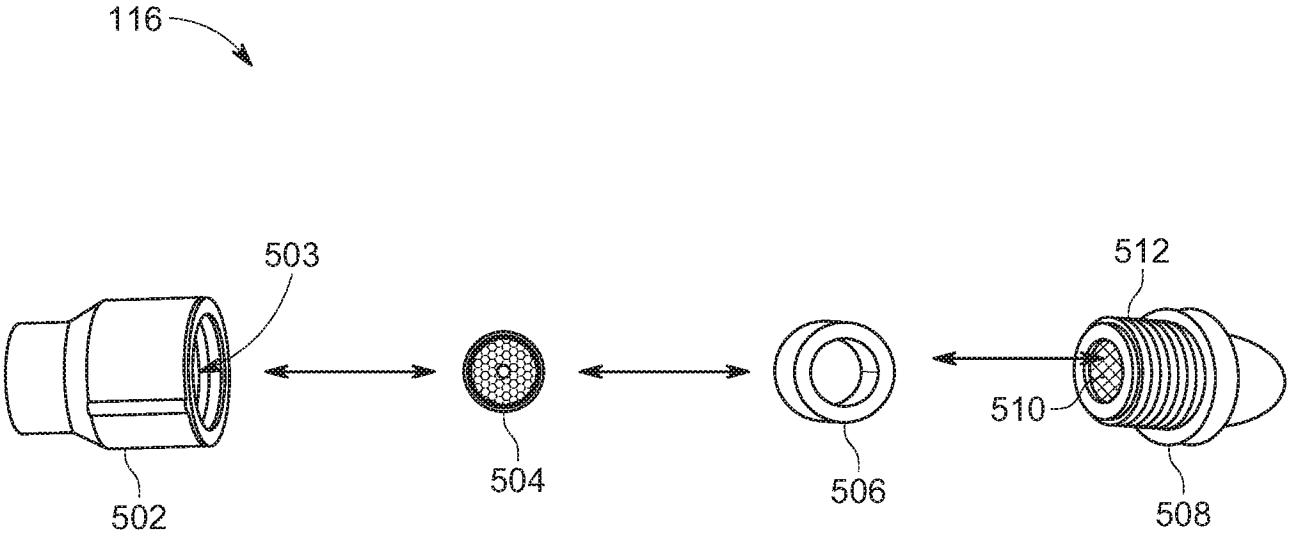
FIG. 5 is a pictorial illustration of an expanded view of an aerator assembly in accordance with an illustrative embodiment.

Turning to FIG. 5, FIG. 5 is a pictorial illustration of an aerator assembly such as aerator assembly 116. The pictorial illustration in FIG. 5 provides an expanded view of one or more exemplary components of aerator assembly 116 and how they may be assembled together. Aerator assembly 116 is also illustrated in FIG. 4 as discussed above and further appears in FIG. 1, FIG. 10, FIG. 13, and FIG. 14.

In one or more non-limiting embodiments, aerator assembly 116 includes housing 502. Housing 502 may be a type of conduit having a small interior bore 503. The front opening and back opening of housing 502 may be connectable to other components. For example, as shown in FIG. 4, the front side of the housing 502 of aerator assembly 116 is connected to the outlet 114 of pedicure tub fitting 112. Housing 502 may include an aerator such as aerator 504 within its bore 503. Aerator 504 is an aerator as known in the art that includes a mesh screen with small holes that break up the water directed through the mesh screen. Aerator 504 breaks up the water stream coming from conduit 122 and returning back to pedicure tub 108 from microbubble generating device 202 and adds additional air to the returning water which helps to contribute to even smaller and finer microbubbles 101 being included in the returning water.

Aerator assembly 116 may further include gasket 506 that fits within a connector, such as connector 508. Connector 508 may be a small connection piece of piping that includes a bore 510 through connector 508. Connector 508 may have threads 512 to threadably engage with the interior of housing 502. It is noted that the orifice of the connector 508 may be sized to suit the water flow through aerator assembly 116. For example, in a non-limiting embodiment, the orifice of the connector 508 may be at least 1/16 inches in diameter. The addition of aerator assembly 116 at the end of the conduit 122 returning the water having microbubbles 101 into the pedicure tub 108 may be necessary for generating the smaller sized microbubbles 101 that are desirable and produce the white, dense, cloudy effect in the water 110 in the pedicure tub 108.

In addition to the aerator assembly 116, the air mixing chamber 238 depicted in FIG. 2 and air mixing core member 240 further contribute to the creation of microbubbles 101 in the water and are located within the housing 204 of the microbubble generating device 202.

It is noted that pedicure tub fitting 112 and aerator assembly 116 may be regularly cleaned using wipes or cleaning solutions so that any bacteria or undesired elements are minimized or eliminated in order to ensure the cleanliness of these parts which makes the washing treatment process more sanitary for the intended user (e.g. whether a human or an animal). The components of tub fitting 112 as shown in FIG. 4 and aerator assembly as shown in FIG. 5 are relatively easily accessible and may be cleaned often.

Figure 6:
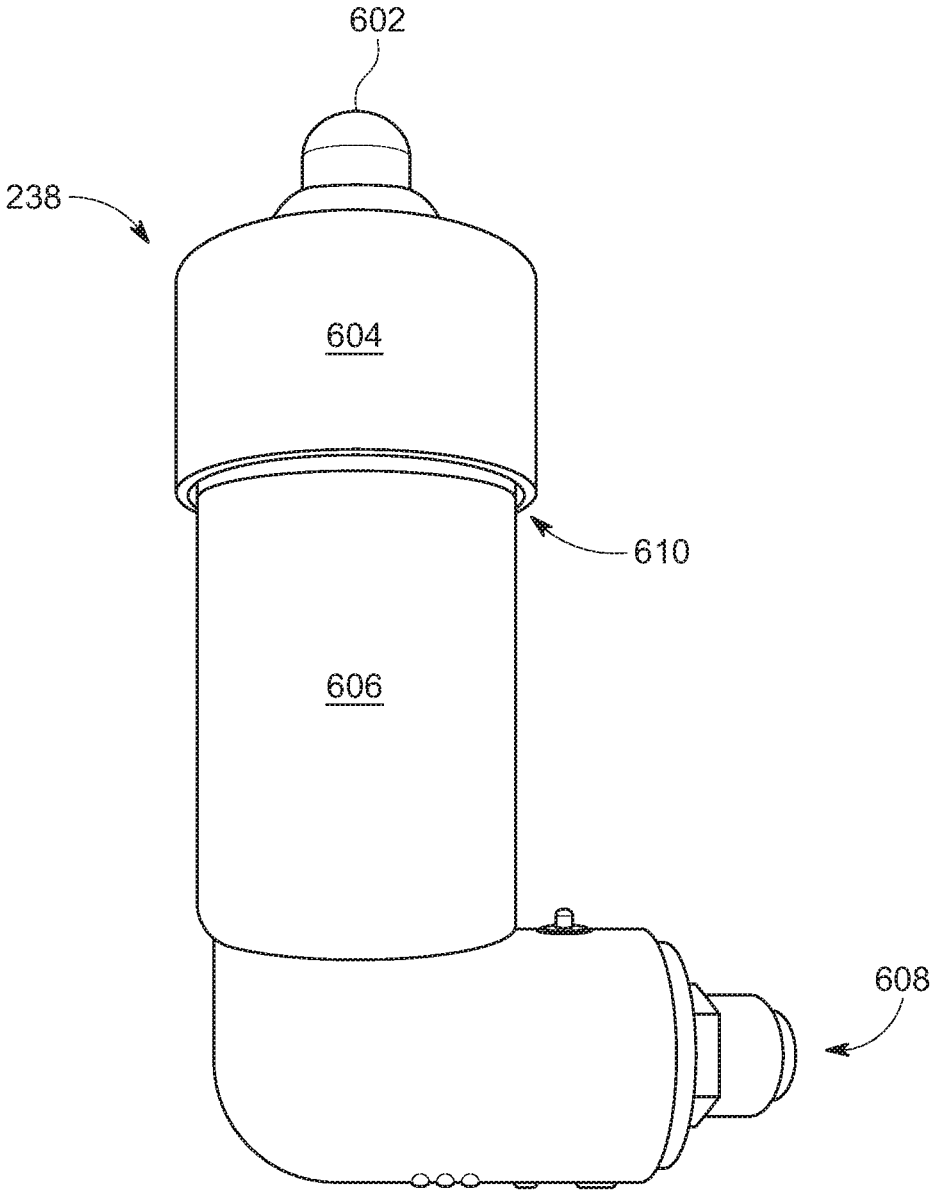
FIG. 6 is a pictorial illustration of an air mixing chamber in accordance with an illustrative embodiment.
Figure 7:
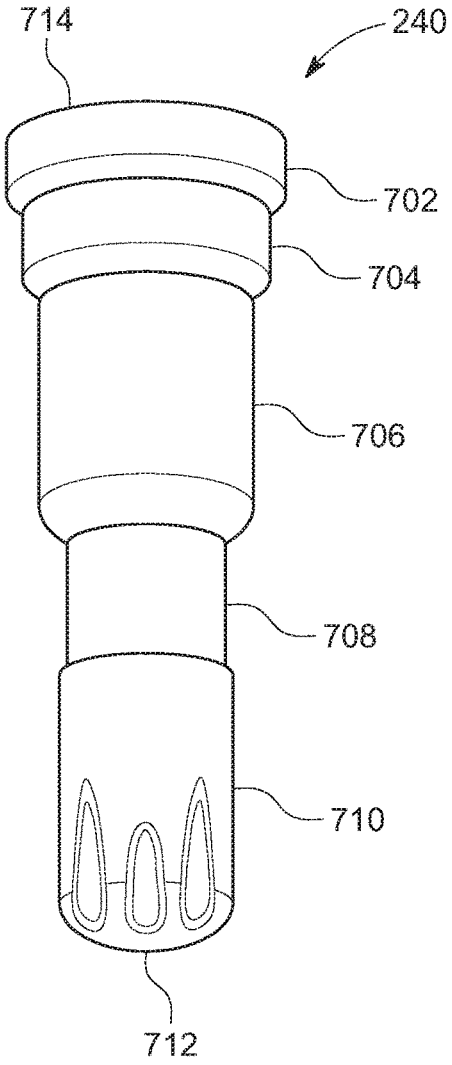
FIG. 7 is a pictorial illustration of an air mixing core member in accordance with an illustrative embodiment.
Figure 8:
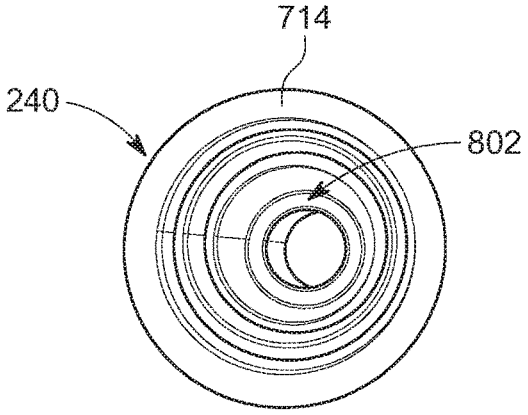
FIG. 8 is a pictorial illustration of top view of the air mixing core member shown in FIG. 7 in accordance with an illustrative embodiment.
Figure 9:
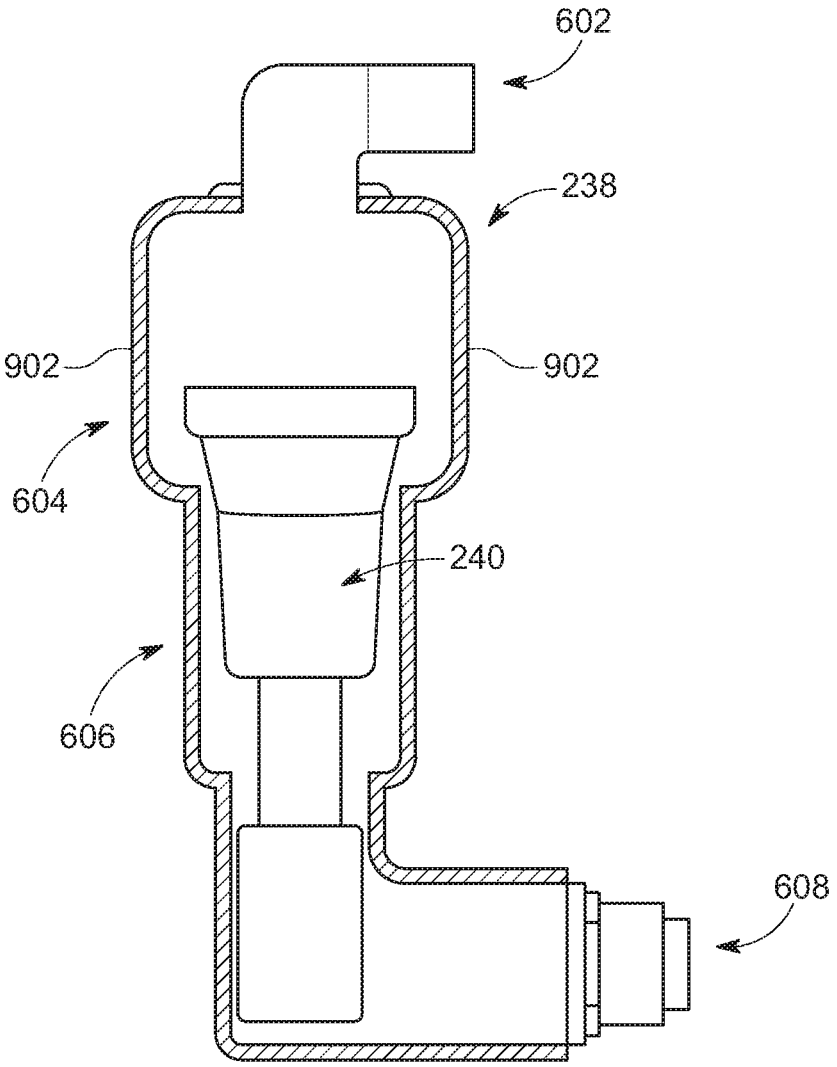
FIG. 9 is a pictorial illustration of a cross-sectional view of an air mixing chamber having an air mixing core member located inside of the air mixing chamber in accordance with an illustrative embodiment.

Turning to FIGS. 6-9, FIGS. 6-9 provide various illustrations of the air mixing chamber 238 and air mixing core member 240 according to one or more non-limiting embodiments. FIG. 6 is a pictorial illustration depicting an exemplary embodiment of air mixing chamber 238. FIG. 7 is a pictorial illustration depicting an exemplary embodiment of air mixing core member 240. FIG. 8 depicts a top down view of the air mixing core member 240 shown in FIG. 7 with a view of the interior of the air mixing core member 240. FIG. 9 depicts a cross-sectional view of air mixing chamber 238 with the air mixing core member 240 located inside of the air mixing chamber 238.

In one or more non-limiting embodiments, in operation, the air mixing core member 240 is located within the inside of the air mixing chamber 238. The air mixing chamber 238 may include a top piece 604 that can fit over the bottom piece 606 of the air mixing chamber 238. The top piece 604 of the air mixing chamber 238 may have a larger diameter than the bottom piece 606 so that the top piece 604 can fit over and onto the top surface of the bottom piece 606 as shown in FIG. 6. Additionally, in one or more non-limiting embodiments, the top piece 604 may be separate from the bottom piece 606 of the air mixing chamber 238 but may be connected or attached together at joint 610 using a sealant or other means of attachment. The air mixing chamber 238, as the name implies, is where the incoming air 130 and incoming water 234 are thoroughly mixed together so as to generate microbubbles 101. The water exiting the air mixing chamber 238 via the outlet 608 of the air mixing chamber 238 includes a plurality of microbubbles 101. While the microbubble generating device 202 is activated or powered on (e.g. connected to power source 232), the pump 226 provides pumping action to direct the flow of the air 130 and incoming water 234 through the inlet 602 of the air mixing chamber 238 and out through the outlet 608 of the air mixing chamber 238.

FIG. 7 provides a pictorial illustration of an exterior of the air mixing core member 240. Air mixing core member 240, in one or more non-limiting embodiments, may be a uniform piece, but in alternative embodiments, air mixing core member 240 may be a collection of pieces.

Air mixing core member 240 may have several tiers such as top tier 702, second tier 704, third tier 706, fourth tier 708, and bottom tier 710. The tiers 702-710 may cascade downwardly, whereby each tier has a decreasing diameter except for the last tier 710 in one non-limiting embodiment. The top surface 714 of tier 702 may have the widest diameter which may narrow progressively down towards the bottom surface 712 of air mixing core member 240.

FIG. 8 depicts an internal view of air mixing core member 240. In one non-limiting embodiment, air mixing core member 240 is hollow on the inside and has a bore 802 that extends from the top surface 714 to the bottom surface 712. As shown in FIG. 8, the tiers 702-710 cascade downwards and have a decreasing diameter.

Turning to FIG. 9, FIG. 9 shows a cross-sectional view of the air mixing core member 240 located in the air mixing chamber 238 in accordance with how the two are arranged in microbubble generating device 202. In a non-limiting embodiment, the air mixing core member 240 is free standing and able to move freely within the air mixing chamber 238. When located within the microbubble generating device 202, the air mixing core member 240 assists in the creation of microbubbles 101. As the air 130 and incoming water 234 mix within the air mixing chamber 202, the movement of the air 130 and incoming water 234 causes the air mixing core member 240 to move within the air mixing chamber 238. Additionally, the air 130 and incoming water 234 may flow within the interior bore 802 of air mixing core member 240 as shown in FIG. 8. The direct contact of the air 130 and incoming water 234 with the exterior and interior surfaces of the air mixing core member 240 helps in the creation of microbubbles 101 within the incoming water 234. The air mixing core member 240 may be described as a "grinder" whereby the contact of the air 130 and incoming water 234 with the air mixing core member 240 assists in forcing the air 130 to form a cavity within the water 234 and form the desired microbubbles 101. As shown in FIG. 9, the incoming water 234 may flow in through the inlet 602 of the air mixing chamber 238. As the air 130 and incoming water 234 flows through the air mixing chamber 238, the air 130 and the incoming water 234 may contact the interior surfaces 902 of air mixing chamber 238. Additionally, any air 130 and incoming water 234 may make contact with the exterior and interior surfaces of air mixing core member 240 while undergoing pumping from the pump 226 and thus produce microbubbles 101. The pump 226 keeps the flow of the air 130 and incoming water 234 at a desired velocity and desired pressure to contribute to the formation of the microbubbles 101. Any outgoing water 236 exiting from the air mixing chamber 238 may include a plurality of microbubbles 101 that may be then directed via conduit 122 to the pedicure tub 108.

Turning to FIG. 10, FIG. 10 is a pictorial illustration depicting a non-limiting embodiment for an exterior of microbubble generating device 202. In one or more non-limiting embodiments, microbubble generating device 202 as shown in FIG. 10 may include a compact housing 204 containing the components of microbubble generating device 202 as shown in FIG. 2 and FIG. 16 in one or more non-limiting embodiments. Further, the power source 232 may be a connection to an electrical outlet such that a power cord is connected to the housing 204 of the microbubble generating device 202. FIG. 10 further shows an example of filter 118 that is located along the conduit (e.g. conduit 120 as shown in FIG. 1) as well as the filter screen 312 located in the opening of inlet 113 of tub fitting 112. Accordingly, there may be a primary filter such as filter screen 312 as well as a secondary filter such as filter 118 in one or more non-limiting embodiments to filter out undesirable elements such as hair, skin, or other elements that may cause blockage in the microbubble generating device 202.

FIG. 10 further depicts an example of pedicure tub fitting 112. Pedicure tub fitting 112 is shown attached to one or more conduits 120 and 122. Normally, the pedicure tub fitting 112 may be located within the pedicure tub 108 and then attached to the one or more conduits 120 and 122 but the illustration in FIG. 10 is meant to provide a visualization of how the components may connect together. Pedicure tub fitting 112 includes a conduit connected to the inlet 113 as well as a conduit connected to the outlet 114 of the pedicure tub fitting 112 as shown in FIG. 3. FIG. 10 further illustrates aerator assembly connected to the outlet 114 of pedicure tub fitting 112.

Turning to FIG. 11, FIG. 11 shows an example of pedicure tub fitting 112 as positioned in pedicure tub 108 in use delivering microbubbles 101 into the pedicure tub 108. The pedicure tub fitting 112 may be positioned in place of a magnet jet that existed in pedicure tub 108. Accordingly, pedicure tub 108 may be retrofitted to include pedicure tub fitting 112 so that the microbubble generating device 202 can be connected to the pedicure tub 108 and produce the cloudy outgoing water 236 with the multiple microbubbles 101. FIG. 11 further illustrates that the pedicure tub fitting 112 may be oriented so that the front surface 320 of the pedicure tub fitting 112 faces the interior basin of pedicure tub 108 so that the outgoing water 236 from the microbubble generating device 202 flows through outlet 114 of the pedicure tub fitting 112 and into the pedicure tub 108. The use of the pump 226 (e.g. as shown in FIG. 2) in the microbubble generating device 202 may further cause the outgoing water 236 from the microbubble generating device 202 to swirl and flow within the pedicure tub 108 at a sufficient speed to further massage and relax the user. Any water in the tub 108 may flow through the inlet 113 of the pedicure tub fitting 112 (as well as through filter screen 312 in one or more non-limiting embodiments) towards the microbubble generating device 202.

Figure 12:
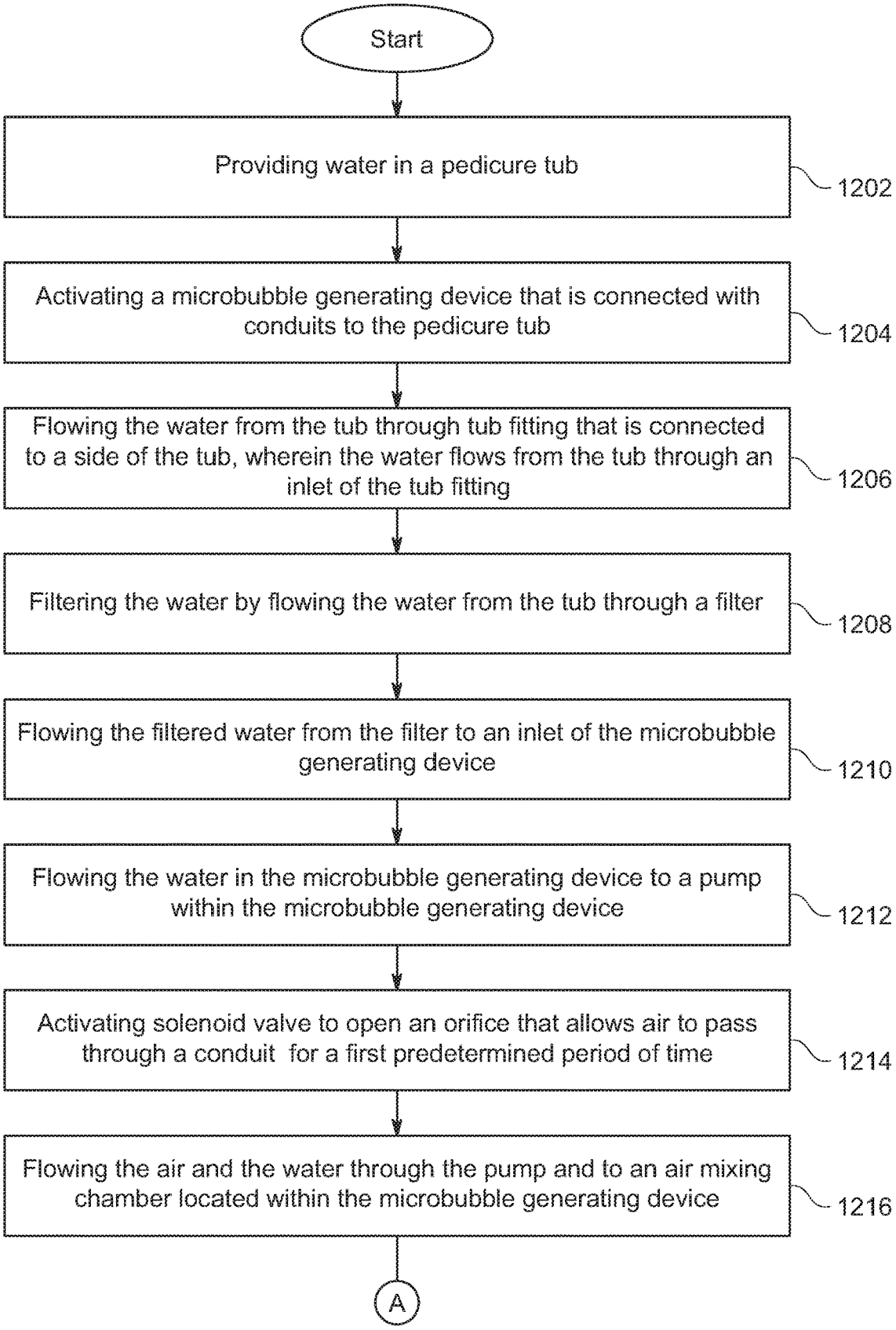
FIG. 12 is a flowchart of a method of using a microbubble generating device for a pedicure tub in accordance with an illustrative embodiment.
Figure 12:
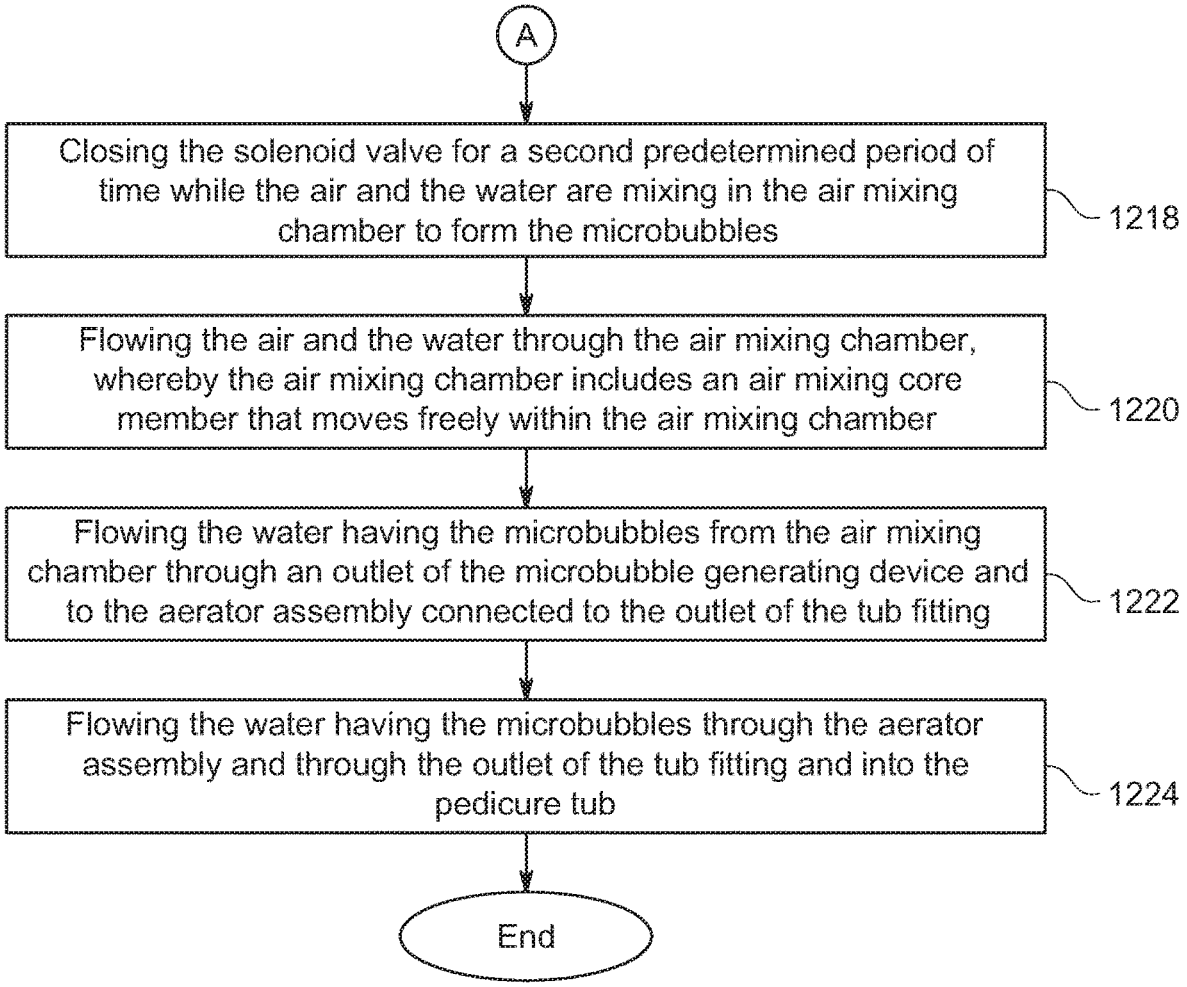

Turning to FIG. 12, FIG. 12 is a flowchart depicting an exemplary method for using the microbubble generating device 202 to generate microbubbles 101 within a pedicure tub, such as pedicure tub 108. At step 1202, the process may begin by providing water 110 in the pedicure tub 108. The water 110 may be provided from one or more faucets attached to the pedicure tub 108 or may be provided from another water source. It may be beneficial for the water level of the water in the pedicure tub 108 to be kept above the inlet 113 and outlet 114 of the pedicure tub fitting 112 so that the water 110 may continuously travel through the inlet 113 of the tub fitting 112 and return through the outlet 114 of the tub fitting 112.

At step 1204, the process may continue with activating microbubble generating device 202 that is connected with one or more conduits (e.g. conduit 120 and conduit 122) to the pedicure tub 108. At step 1206, the water 110 from the pedicure tub 108 is enabled to flow from the pedicure tub 108 through a pedicure tub fitting 112 that is connected to a side of the pedicure tub 108. The water 110 from the pedicure tub 108 may flow from the inlet 113 of the pedicure tub fitting 112. At step 1208, the water 110 from the pedicure tub 108 may be filtered by flowing the water 110 through a filter, such as filter 118.

At step 1210, the process may continue by flowing the filtered water 110 to an inlet 210 of microbubble generating device 202. At step 1212, the incoming water 234 may flow to a pump, such as pump 226 located within the microbubble generating device 202. At step 1214, the solenoid valve 228 may be activated to open an orifice in a conduit 224 within the microbubble generating device 202 that allows air 130 to pass through the conduit 224 for a first predetermined period of time. At step 1216, the air 130 and the incoming water 234 may flow through the pump 226 and to an air mixing chamber 238 located within the microbubble generating device 202. At step 1218, the solenoid valve 228 may be closed for a second predetermined period of time while the air 130 and the incoming water 234 are mixing in the air mixing chamber 238 to form the microbubbles 101. At step 1220, the air 130 and incoming water 234 may flow through the air mixing chamber 238 whereby the air mixing chamber 238 includes an air mixing core member 240 that moves freely within the air mixing chamber 238. At step 1222, the outgoing water 236 having the plurality of microbubbles 101 may flow from the air mixing chamber 238 through an outlet 212 of the microbubble generating device 202. The outgoing water 236 may be directed to the aerator assembly 116 that is connected to the outlet 114 of the pedicure tub fitting 112. At step 1224, the outgoing water 236 from the microbubble generating device 202 having the plurality of microbubbles 101 may pass through the aerator assembly 116 and through the outlet 114 of the pedicure tub fitting 112 and into the reservoir of the pedicure tub 108. Thus, the customer is able to benefit from the health and therapeutic effects of microbubbles 101 during their pedicure. As noted above, the method may further include locating a pedicure chair 104 proximate to the pedicure tub 108 or including a pedicure chair 104 that is already attached to the pedicure tub 108. Further, the method may include attaching the microbubble generating device 202 to the pedicure chair 104 or locating the microbubble generating device 202 near the pedicure tub 108 in order to allow the user to sit comfortably during the pedicure.

Figure 13:
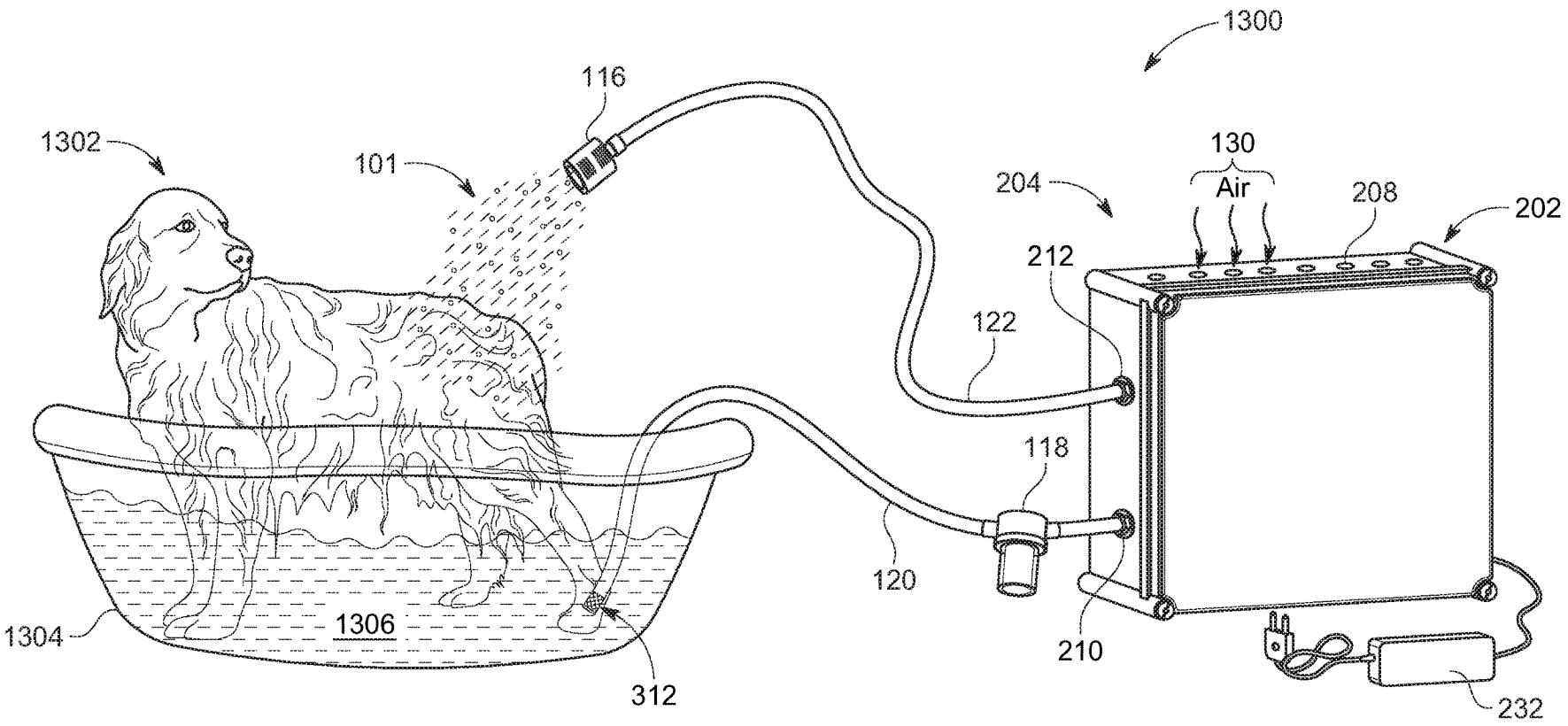
FIG. 13 is a diagram of a system using a microbubble generating device with a tub that may be used to wash an animal or other entities in accordance with an illustrative embodiment.

Turning to FIG. 13, FIG. 13 may be a pictorial illustration depicting a system such as system 1300 that enables a user to use microbubble generating device 202 with any type of tub 1304 even if tub 1304 is not specifically adapted for or useable as a pedicure tub such as pedicure tub 108 shown above in FIG. 1.

As shown in the system 1300 in FIG. 13, in one non-limiting embodiment, microbubble generating device 202 may be used to produce microbubbles 101 to improve the cleaning and bathing experience for a pet or other animal 1302. As shown in FIG. 13, in one non-limiting embodiment, the pet 1302 may be a dog. Tub 1304 may be any type of tub the user desires to use for infusing microbubbles 101 within tub 1304. Tub 1304 may be used for any purpose the user desires and may be used to wash and thoroughly clean any part of a human or animal. Tub 1304 may further be used to wash and thoroughly clean any other type of item or object. In one or more non-limiting embodiments, tub 1304 may even be used as a pedicure tub so that the user may receive a pedicure using tub 1304. Tub 1304 may include one or more side walls and a basin or reservoir filled with water 1306. The user may provide water 1304 in tub 1304 from any suitable water source. If the microbubble generating device 202 may be used to wash a pet 1302, the pet 1302 may be located within the tub 1304. As noted above, the pet 1302 should experience a relaxing and enhancing washing experience because of the inclusion of microbubbles 101.

The system 1300 shown in FIG. 13 is very similar to the system 100 shown in FIG. 1. System 1300 may utilize microbubble generating device 202 which may have the same components as shown in FIG. 2. Accordingly, the microbubble generating device 202 shown in FIG. 13 may operate in accordance with the microbubble generating device 202 shown in FIG. 2, which may include pump 226 to pump air 130 and water 234 through the pump 226 towards an air mixing chamber 238 that includes air mixing core member 240. Additionally, the housing 204 of microbubble generating device 202 may include one or more openings 208 (not shown in FIG. 13) that may be used to dissipate heat from the microbubble generating device 202 as well as to allow access to the air 130 from the environment which may flow through the openings 208.

The microbubble generating device 202 may include inlet 210 and outlet 212. Conduit 120 may be arranged so that one end of conduit 120 is submerged beneath the water surface level of the water 1306 in the tub 1304. The other end of the conduit 120 may be connected to inlet 210 of microbubble generating device 202. The conduit 120 may include one or more filters such as filter 312 and filter 118 to filter out unwanted elements from the water 1306 in the tub 1304, including hair, skin, or any other elements that may be filtered through filter 118. Filter 312 and filter 118 may be in accordance with filter 312 and filter 118 as described above and shown in FIG. 1, FIG. 3, and FIG. 5. In one or more non-limiting embodiments, filter 312 and filter 118 may be located externally from microbubble generating device 202 so that the filter 118 may be easily cleaned and/or replaced as needed. Multiple filters 118 may be positioned in system 1300 along the conduits 120 or 122 or even located internally within microbubble generating device 202.

Conduit 122 may be a conduit connected to the outlet 212 of microbubble generating device 202. Any outgoing water 236 having microbubbles 101 exiting the outlet 212 of the microbubble generating device 202 may be routed through aerator assembly 116 and then into the tub 1304 as well as over the body of the pet 1302 or other entity being washed. Aerator assembly 116 acts in accordance with the description provided above for aerator assembly 116 as shown in FIG. 5 in which the size of the microbubbles 101 of the outgoing water 236 exiting the microbubble generating device 202 may be made smaller and finer after passing through the aerator assembly 116. Any outgoing water 236 exiting the aerator assembly 116 having the microbubbles 101 may cause the water 1306 in tub 1304 to appear cloudy and white, thereby indicating the presence of microbubbles 101. Advantageously, the system 1300 is designed such that tub 1304 does not need a tub fitting such as tub fitting 112 in order for the microbubbles 101 to be provided through the conduit 122 and aerator assembly 116 to the pet 1302. It may be beneficial for conduit 120 to be submerged beneath the surface water level of the water 1306 so that the water 1306 may be continuously directed out of the tub 1304 towards the microbubble generating device 202 once the microbubble generating device 202 is activated or powered on for a period of time. The user may turn off or deactivate the microbubble generating device 202 at any time which will cause the returned water having the microbubbles 101 to stop flowing out of the aerator assembly 116 from conduit 122.

Advantageously, microbubble generating device 202 may be compact, lightweight, and portable so that microbubble generating device 202 may be easily used where needed to clean pet 1102 or any other entity. Additionally, in a non-limiting embodiment, microbubble generating device 202 may be connected to standard electrical outlets to provide power to microbubble generating device 202, although in alternative embodiments, other power sources 232 may be used to power microbubble generating device 202 such as batteries.

Figure 14:
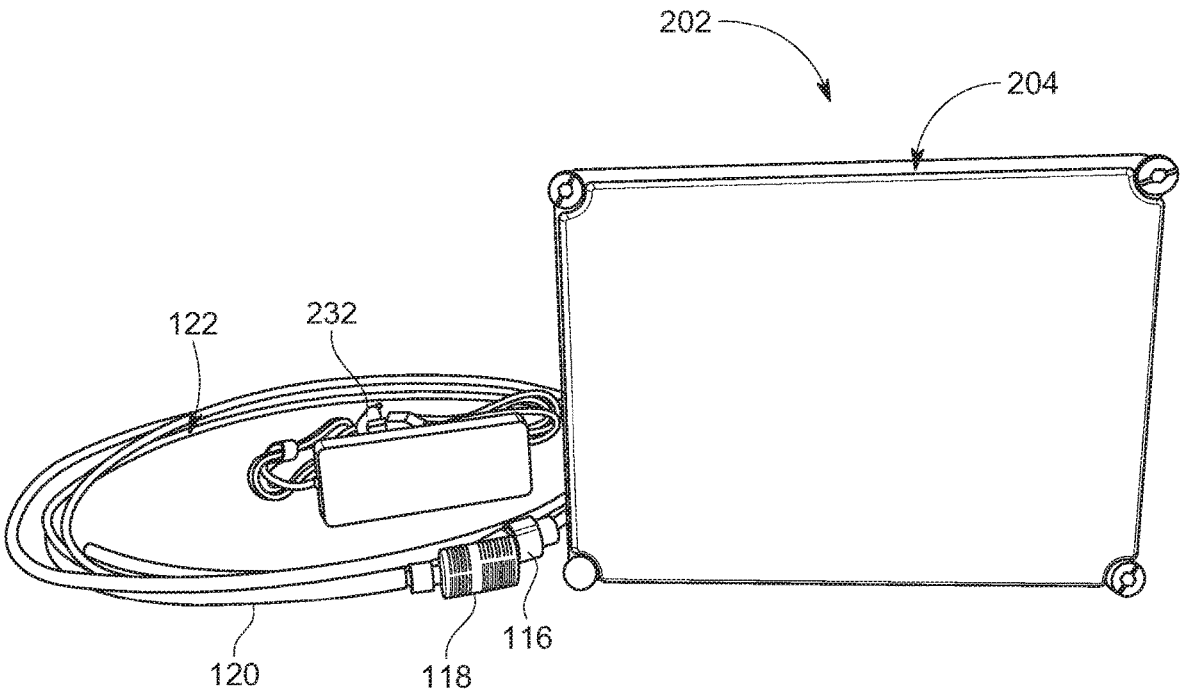
FIG. 14 is a pictorial illustration of a microbubble generating device for any type of tub in accordance with an illustrative embodiment.

Turning to FIG. 14, FIG. 14 depicts an example of microbubble generating device 202 that may be used to wash a pet 1302 or other entity in system 1300. The components of microbubble generating device 202 as shown in the block diagram of FIG. 2 and in the interior view shown in FIG. 16 may be included within the housing 204 of microbubble generating device 202 as shown in FIG. 14.

In one or more non-limiting embodiments, the microbubble generating device 202 shown in FIG. 14 may be located near or proximate to tub 1304. The aerator assembly 116 may be connected to an opening of the conduit 122 and outgoing water 238 having a plurality of microbubbles 101 dispensed directly from the aerator assembly 116 onto the pet 1302 and into the tub 1304. Any water dispensed from the aerator assembly 116 will have a whiter, cloudier appearance as the water pours out of the aerator assembly 116 and into the tub 1304 due to the presence of the microbubbles 101. As shown in FIG. 14, the one or more filters 118 may be positioned at the end of conduit 120 near the inlet 210 of microbubble generating device 202 in one non-limiting embodiment.

Figure 15:
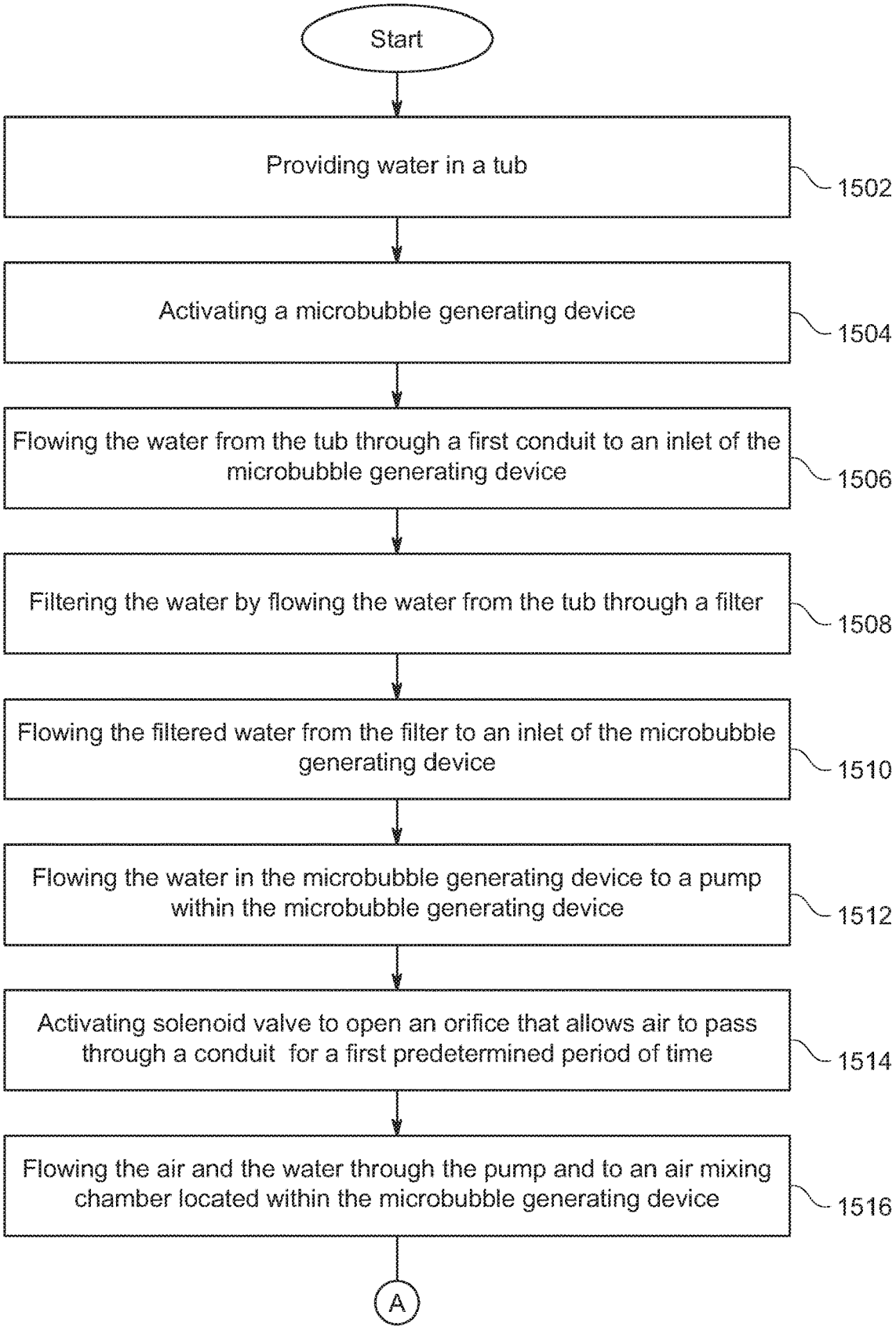
FIG. 15 is a flowchart of a method of using a microbubble generating device for any type of tub in accordance with an illustrative embodiment.
Figure 15:
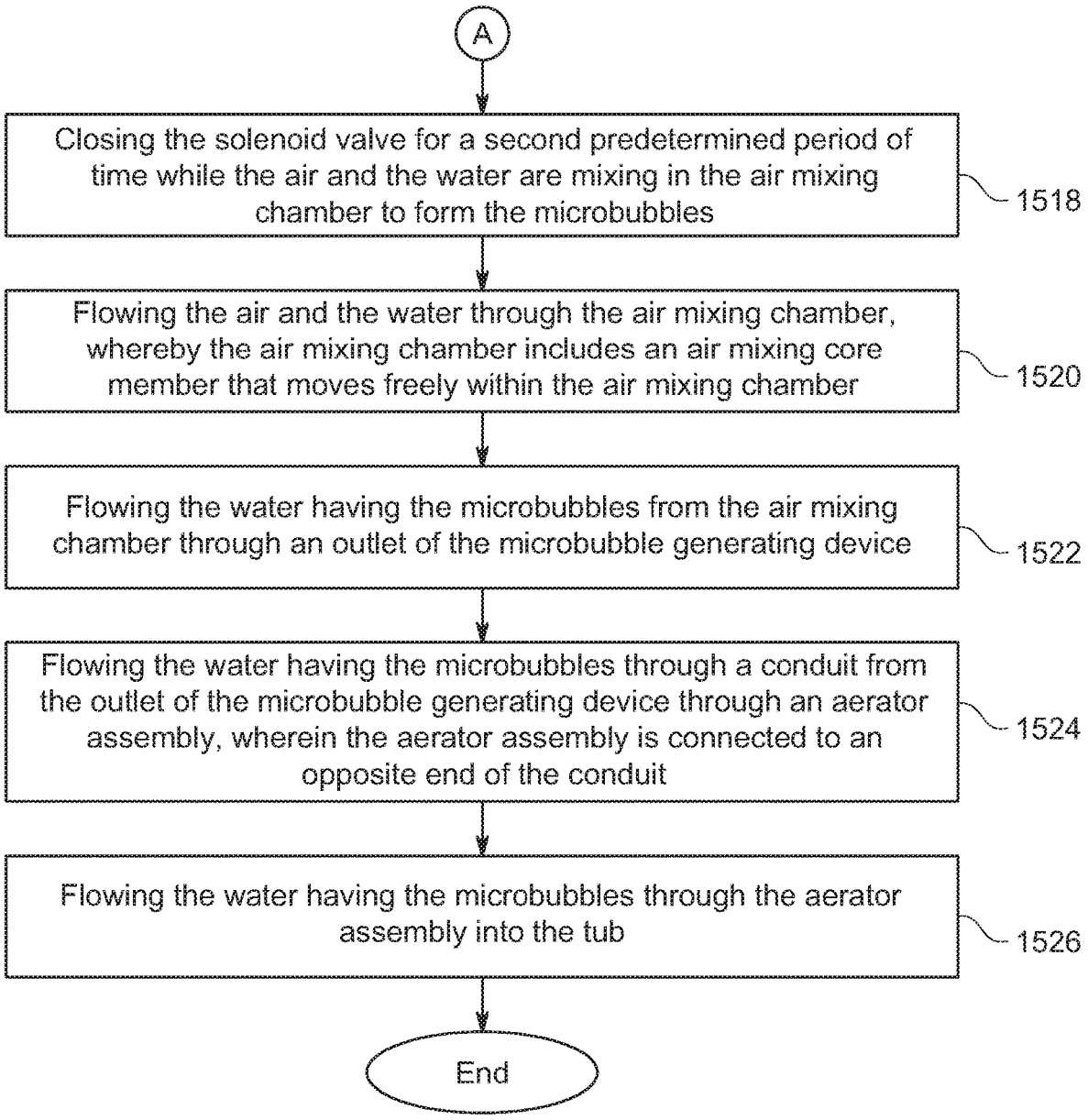

Turning to FIG. 15, FIG. 15 is a flowchart depicting an exemplary method of using a microbubble generating device 202 with any type of tub 1304. At step 1502, the process may begin by providing water 1306 in a tub 1304. At step 1504, the microbubble generating device 202 may be activated. At step 1506, the process may continue by flowing the water 1306 from the tub 1304 through a first conduit 120 to an inlet 210 of the microbubble generating device 202. At step 1508, the water 1306 may be filtered by flowing the water 1306 through a filter 118. At step 1510, the filtered water 1306 may flow from the filter 118 to an inlet 210 of the microbubble generating device 202. At step 1512, the incoming water 234 may flow in the microbubble generating device 202 to a pump, such as pump 226 located within microbubble generating device 202. At step 1514, the process may continue by activating the solenoid valve 228 to open an orifice in a conduit 224 that allows air 130 to travel through the conduit 224 for a first predetermined period of time. At step 1516, the air 130 and the incoming water 234 may flow through the pump 226 and to an air mixing chamber 238 located within the microbubble generating device 202. At step 1518, the solenoid valve 228 may be closed for a second predetermined period of time while the air 130 and the incoming water 234 are mixing in the air mixing chamber 238 to form the microbubbles 101. At step 1520, the air 130 and the incoming water 234 may flow through the air mixing chamber 238, whereby the air mixing chamber 238 includes an air mixing core member 240 that moves freely within the air mixing chamber 238.

At step 1522, the outgoing water 236 having microbubbles 101 flows from the air mixing chamber 238 through an outlet 212 of the microbubble generating device 202. At step 1524, the outgoing water 236 having microbubbles 101 flows through the conduit 122 from the outlet 212 of the microbubble generating device 202 through aerator assembly 116, whereby the aerator assembly 116 is connected to an opposite end of the conduit 122 (i.e. the end of the conduit 122 oriented towards the tub 1304 as shown in FIG. 13). At step 1526, the outgoing water 236 having the microbubbles 101 may flow through the aerator assembly 116 and into the tub 1304 to wash any animal 1302 or other entity located in the tub 1304. It may be beneficial for the microbubble generating device 202 to be conveniently positioned relatively near the tub 1304 for easy transport of the water to and from the tub 1304 and for the conduits 120 and 122 to reach.

Accordingly, the present description provides for various embodiments for a microbubble generating device, systems, and one or more exemplary methods of use. Many uses and advantages are offered by these microbubble generating systems as described above in one or more non-limiting embodiments. The microbubble generating device may be relatively compact, portable, and used in various locations for convenient washing and incorporation of the microbubbles into a tub. Further, the microbubble generating device may be attached to one or more pedicure chairs or located near a pedicure chair to conveniently include the microbubbles in the pedicure treatment. Additionally, a tub may be retrofitted to include the pedicure tub fitting discussed above so that the microbubbles may be routed to the pedicure tub fitting and into the tub. This may allow owners of pedicure chairs or tubs to save money by not having to purchase brand new tubs or chairs and providing them with the option to retrofit these items. Many additional advantages and uses are offered by the one or more systems described herein.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A microbubble generating device adapted to produce microbubbles, the microbubble generating device comprising:

a housing having an inlet and an outlet, wherein the inlet is configured to flow incoming water through the inlet in order for the microbubbles produced by the microbubble generating device to be added to the incoming water;

one or more openings that are located on the housing, wherein the one or more openings allow air from a surrounding environment of the microbubble generating device to be directed through the one or more openings and into the housing;

one or more conduits configured to direct the air and the water within the housing of the microbubble generating device;

a solenoid valve;

a timer, wherein the timer is configured to control the solenoid valve;

an air mixing chamber, the air mixing chamber further comprising an air mixing core member that is disposed within the air mixing chamber, wherein the air mixing core member is free standing and able to move within the air mixing chamber; and a pump, wherein the pump is configured to pump the air and the incoming water to the air mixing chamber, wherein the outlet of the microbubble generating device is configured to direct outgoing water from the air mixing chamber, wherein the outgoing water comprises a plurality of the microbubbles.

2. The microbubble generating device of claim 1, further comprising an inlet conduit that is configured to transport the incoming water into the microbubble generating device.

3. The microbubble generating device of claim 2, wherein the inlet conduit further comprises one or more filters located along the inlet conduit, wherein the one or more filters are configured to filter out undesirable elements in the incoming water.

4. The microbubble generating device of claim 2, wherein the inlet conduit is configured to attach at one end to an outlet of a tub fitting, the tub fitting configured to be attached to a pedicure tub.

5. The microbubble generating device of claim 1, further comprising an outlet conduit that is configured to transport the outgoing water having the microbubbles away from the microbubble generating device to a tub.

6. The microbubble generating device of claim 5, wherein the outlet conduit is configured to attach at one end to an outlet of a tub fitting, the tub fitting configured to be attached to a pedicure tub.

7. The microbubble generating device of 5, wherein the outlet conduit is attached to an aerator assembly, the aerator assembly being configured to produce smaller and finer microbubbles in the outgoing water.

8. The microbubble generating device of claim 7, wherein the aerator assembly is configured to be attached to an outlet of a tub fitting, wherein the outgoing water is configured to pass through the aerator assembly, then through the outlet of the tub fitting, and into the tub.

9. The microbubble generating device of claim 1, the microbubble generating device further comprising a power source.

10. A system for generating microbubbles in a pedicure tub, the system comprising:

the pedicure tub, wherein the pedicure tub is configured for providing a pedicure to a user and for containing water, wherein the pedicure tub includes an opening located on one side of the pedicure tub;

a tub fitting, wherein the tub fitting is configured to fit in the opening located on the one side of the pedicure tub, the tub fitting further comprising:

a body having an inlet and an outlet, wherein the water in the pedicure tub is configured to flow from the pedicure tub through the inlet of the tub fitting to a microbubble generating device, and wherein the microbubbles that are generated using the microbubble generating device are configured to flow into the outlet of the tub fitting and into the pedicure tub;

one or more filters;

a first conduit, wherein the one or more filters is connected by the first conduit to the inlet of the tub fitting;

the microbubble generating device, the microbubble generating device having an inlet and an outlet, wherein the first conduit connects the one or more filters to the inlet of the microbubble generating device; and a second conduit, wherein the second conduit connects the outlet of the microbubble generating device to the outlet of the tub fitting.

11. The system of claim 10, the microbubble generating device further comprising:

a housing, the housing further comprising:

one or more openings disposed on the housing to allow air into the housing of the microbubble generating device;

a pump, wherein the incoming water from the first conduit and the air is configured to flow through an inlet of the pump;

a solenoid valve, wherein the solenoid valve is configured to regulate a flow of the air in the housing of the microbubble generating device;

a timer, wherein the timer is electrically connected to the solenoid valve and configured to control the solenoid valve; and an air mixing chamber, wherein the air mixing chamber further comprises an air mixing core member, wherein the air mixing core member is located within the air mixing chamber, wherein the air mixing core member assists in the generation of the microbubbles.

12. The system of claim 11, wherein the air mixing core member is free standing and able to move within the air mixing chamber.

13. The system of claim 10, wherein the one or more filters are located externally to the housing of the microbubble generating device in order to have access to the one or more filters to clean or replace the one or more filters, wherein a first filter is located in the inlet of the tub fitting and a secondary filter is located along the first conduit.

14. The system of claim 10, further comprising an aerator assembly, wherein the aerator assembly is connected to the second conduit on one end and connected to the outlet of the tub fitting on the other end, wherein outgoing water from the microbubble generating device passes through the aerator assembly before returning to the pedicure tub through the outlet of the tub fitting.

15. The system of claim 14, wherein the aerator assembly comprises a housing and an aerator, wherein the aerator is disposed within the housing of the aerator assembly.

16. A method for generating microbubbles in water in a tub, the method comprising:

providing the water in the tub;

activating a microbubble generating device connected to the tub, wherein a housing of the microbubble generating device comprises an inlet, an outlet, one or more openings, a pump, a solenoid valve, a timer, and an air mixing chamber;

flowing the water from the tub through a first conduit to one or more filters;

filtering the water from the tub by flowing the water from the tub through the one or more filters;

flowing the water from the one or more filters to the inlet of the microbubble generating device;

flowing the water within the microbubble generating device to the pump;

activating the solenoid valve to open an orifice in a conduit that provides access to air for a first predetermined period of time;

flowing the air and the water through the pump and to the air mixing chamber located within the housing of the microbubble generating device, the air mixing chamber further comprising an air mixing core member that is disposed within the air mixing chamber, wherein the air mixing core member is free standing and able to move within the air mixing chamber;

closing the solenoid valve for a second predetermined period of time while the air and the water are mixing in the air mixing chamber;

flowing the air and the water through the air mixing chamber to form the microbubbles wherein the movement of the free standing air mixing core member within the air mixing chamber assists in the creation of the microbubbles;

flowing the water having the microbubbles from the air mixing chamber through the outlet of the microbubble generating device; and flowing the water having the microbubbles from the microbubble generating device through a second conduit to the tub.

17. The method of claim 16, wherein the tub is used for cleaning a human or an animal.

18. The method of claim 16, wherein flowing the water having the microbubbles from the microbubble generating device through the second conduit to the tub further comprises:

flowing the water having the microbubbles through an aerator assembly, wherein the aerator assembly is connected to the second conduit.

19. The method of claim 16, further comprising, attaching a tub fitting to the tub, wherein the tub is useable for providing pedicures and containing the water, wherein the tub fitting includes an inlet and an outlet.

20. The method of claim 19, further comprising, flowing the water from the tub through the inlet of the tub fitting to the one or more filters and then to the inlet of the microbubble generating device.

21. The method of claim 19, further comprising, removing a jet located in an opening on the pedicure tub and replacing the jet with the tub fitting in order to retrofit the tub to produce the microbubbles and to connect to the microbubble generating device.

22. The method of claim 19, further comprising, providing a pedicure chair that is connected to or located proximate to the tub.

23. The method of claim 22, further comprising, locating the microbubble generating device proximate to the pedicure chair or beneath a base of the pedicure chair.

24. The method of claim 22, further comprising, attaching the microbubble generating device to the pedicure chair.

* * * * *